US005731530A

United States Patent [19]

Fujiwara et al.

[11] Patent Number: 5,731,530

[45] Date of Patent: Mar. 24, 1998

[54] AUTOMATIC PLAYER PIANO EXACTLY REPRODUCING SPECIAL TOUCHES

[75] Inventors: Yuji Fujiwara; Rei Furukawa; Yasuhiko Oba, all of Shizuoka, Japan

[73] Assignee: Yamaha Corporation, Japan

[21] Appl. No.: 743,951

[22] Filed: Nov. 5, 1996

[30] Foreign Application Priority Data

Nov. 7, 1995 [JP] Japan ..... 7-288933

[51] Int. Cl.[6] ..... G10F 1/02

[52] U.S. Cl. ..... 84/21; 84/115; 84/462

[58] Field of Search ..... 84/615, 626, 658, 84/20–22, 115, 462, DIG. 7

[56] References Cited

U.S. PATENT DOCUMENTS

| | | | |
|---|---|---|---|
| 5,083,491 | 1/1992 | Fields | 84/21 |
| 5,451,708 | 9/1995 | Fujiwara et al. | 84/21 |
| 5,523,522 | 6/1996 | Koseki et al. | 84/21 |

*Primary Examiner*—Stanley J. Witkowski
*Attorney, Agent, or Firm*—Graham & James LLP

[57] ABSTRACT

An automatic player piano records not only regular key-on event/impact event/regular key-off event representative of a regular key motion between a rest position and an end position but also irregular key-on event/irregular key-off event representative of an irregular key motion changing the direction at an intermediate point between the rest position and the end position so as to exactly reproduce an original performance.

10 Claims, 16 Drawing Sheets

AUTOMATIC PLAYER PIANO EXACTLY REPRODUCING SPECIAL TOUCHES

FIELD OF THE INVENTION

This invention relates to an automatic player piano and, more particularly, to an automatic player piano exactly reproducing special touches.

DESCRIPTION OF THE RELATED ART

An automatic player piano is the combination of an acoustic piano and an automatic recording/playing system. The automatic player piano is performable by a player as similar to an acoustic piano, and the automatic recording/playing system can record the performance in a memory such as a floppy disk. The automatic recording/playing system sequentially reads out the pieces of music data information from the memory, and selectively energizes solenoid-operated actuators provided under the keyboard so as to move the keys as if the player fingers on the keyboard, again. Thus, the automatic recording/playing system reproduces the original performance with the solenoid-operated actuators on the basis of the pieces of music data information.

When a player simply depresses a key, the key is moved from the rest position to the end position. The key action mechanism associated with the depressed key leaves the damper head of a damper mechanism from a set of strings on the way from the rest position to the end position, and, thereafter, a hammer escapes from the key action mechanism also on the way to the end position. Then, the hammer starts a free rotation toward the set of strings, and strikes the strings so as to generate an acoustic piano sound.

After reaching the end position, the depressed key is released, and the key is moved from the end position toward the rest position. The associated key action mechanism allows the damper head to be brought into contact with the set of strings, and the damper head takes up the vibrations of the strings so as to extinguish the acoustic sound.

Depressing a key from the rest position to the end position and releasing the key at the end position are the standard key touch, and the automatic recording/playing system produces music data codes representative of a key code assigned to the depressed key, the key velocity from the rest position to the end position, the first timing at which the hammer strikes the strings, the key code assigned to the released key and the second timing at which the damper head is brought into contact with the strings again. The key code is corresponding to a note of the scale, and the key velocity is measured at an interval as close to the strings as possible. The automatic recording/playing system reproduces the acoustic sound through a strike at the strings at the first timing, and extinguishes the acoustic sound by contacting the damper head with the strings at the second timing. For this reason, the first timing and the second timing are hereinbelow referred to as "impact timing" and "extinct timing".

However, while a pianist is playing an acoustic piano, the acoustic sounds are produced through not only the standard key touch but also various non-standard key touches. For example, a key may be released before reaching the end position, which is hereinbelow referred to as "shallow repetition", or depressed before perfectly recovering to the rest position, which is hereinbelow referred to as "deep repetition". The deep repetition may be irregularly combined with the shallow repetition, and the combination is hereinbelow referred to as "irregular repetition". "Silent note" is one of the non-standard key touches, and a slowly depressed key causes the damper mechanism to leave the damper head from the strings without a strike at the strings. Glissand is achieved by a shallow key touch. A key may be scarcely depressed at the second time in a repetition. Though not classified in the non-standard key touch, a pianist sometimes mistakenly depresses a key, and the key is slightly sunk from the rest position. Using these non-standard key touches, a pianist plays with expression.

However, the prior art automatic player piano controls the solenoid-operated actuators on the assumption that a pianist plays a tune through the standard key touch only. For this reason, the prior art automatic player piano can not faithfully reproduce the tune in the playback mode.

SUMMARY OF THE INVENTION

It is therefore an important object of the present invention to provide an automatic player piano which can reproduce the non-standard key touches in an original performance.

In accordance with one aspect of the present invention, there is provided an automatic player piano comprising: an acoustic piano including a plurality of vibrating means for generating acoustic sounds through vibrations thereof, and a plurality of striking mechanisms respectively associated with the plurality of vibrating means and selectively actuated from a first position toward a second position so as to make vibrating means associated with actuated striking mechanisms vibrate; and an automatic playing system including a plurality of actuators respectively associated with the plurality of striking mechanisms for selectively actuating the plurality of striking mechanisms, a plurality of monitoring means respectively associated with the plurality of striking mechanisms for generating a plurality of pieces of status data information respectively representative of motions of the plurality of striking mechanisms, and a recording sub-system connected to the plurality of monitoring means for obtaining the plurality of pieces of status data information, and generating at least a first piece of music data information representative of a regular key-on event for one of the plurality of striking mechanisms actuated from the first position to the second position, a second piece of music data information representative of an impact event for one of the plurality of striking mechanisms which makes associated one of the plurality of vibrating means generate the acoustic sound, a third piece of music data information representative of a regular key-off event for one of the plurality of striking mechanisms moved from the second position to the first position, a fourth piece of music data information representative of an irregular key-on event for one of the plurality of striking mechanisms actuated at a first intermediated point between the first position and the second position toward the second position and a fifth piece of music data information representative of an irregular key-off event for one of the plurality of striking mechanism moved from a second intermediate point between the first position and the second position toward the first position, the first, second and third pieces of music data information is used for reproducing a key motion analogous to an original key motion having the regular key-on event and the regular key-off event, and at least one of the fourth piece of music data information and the fifth piece of music data information is used for producing another key motion having at least one of the irregular key-on event and the irregular key-off event together with at least one of the first, second and third pieces of music data information.

In accordance with another aspect of the present invention, there is provided an automatic player piano comprising: an acoustic piano including a plurality of vibrating means for generating acoustic sounds through vibrations thereof, and a plurality of striking mechanisms respectively associated with the plurality of vibrating means and selectively actuated from a first position toward a second position so as to make vibrating means associated with actuated striking mechanisms vibrate; and an automatic playing system including a plurality of actuators respectively associated with the plurality of striking mechanisms for selectively actuating the plurality of striking mechanisms, and a playback sub-system connected to the plurality of actuators for reproducing a regular key motion on the basis of a first piece of music data information representative of a regular key-on event for one of the plurality of striking mechanisms actuated from the first position to the second position, a second piece of music data information representative of an impact event for the aforesaid one of the plurality of striking mechanisms which makes associated one of the plurality of vibrating means generate the acoustic sound, and a third piece of music data information representative of a regular key-off event for one of the plurality of striking mechanisms moved from the second position to the first position and an irregular key motion on the basis of at least one of a fourth piece of music data information representative of an irregular key-on event for another of the plurality of striking mechanisms actuated at a first intermediated point between the first position and the second position toward the second position, and a fifth piece of music data information representative of an irregular key-off event for yet another of the plurality of striking mechanism moved from a second intermediate point between the first position and the second position toward the first position together with at least one of the first, second and third pieces of music data information.

BRIEF DESCRIPTION OF THE DRAWINGS

The features and advantages of the automatic player piano according to the present invention will be more clearly understood from the following description taken in conjunction with the accompanying drawings in which.

DESCRIPTION OF THE PREFERRED EMBODIMENT

Structure of Automatic Player Piano

Figure 1:
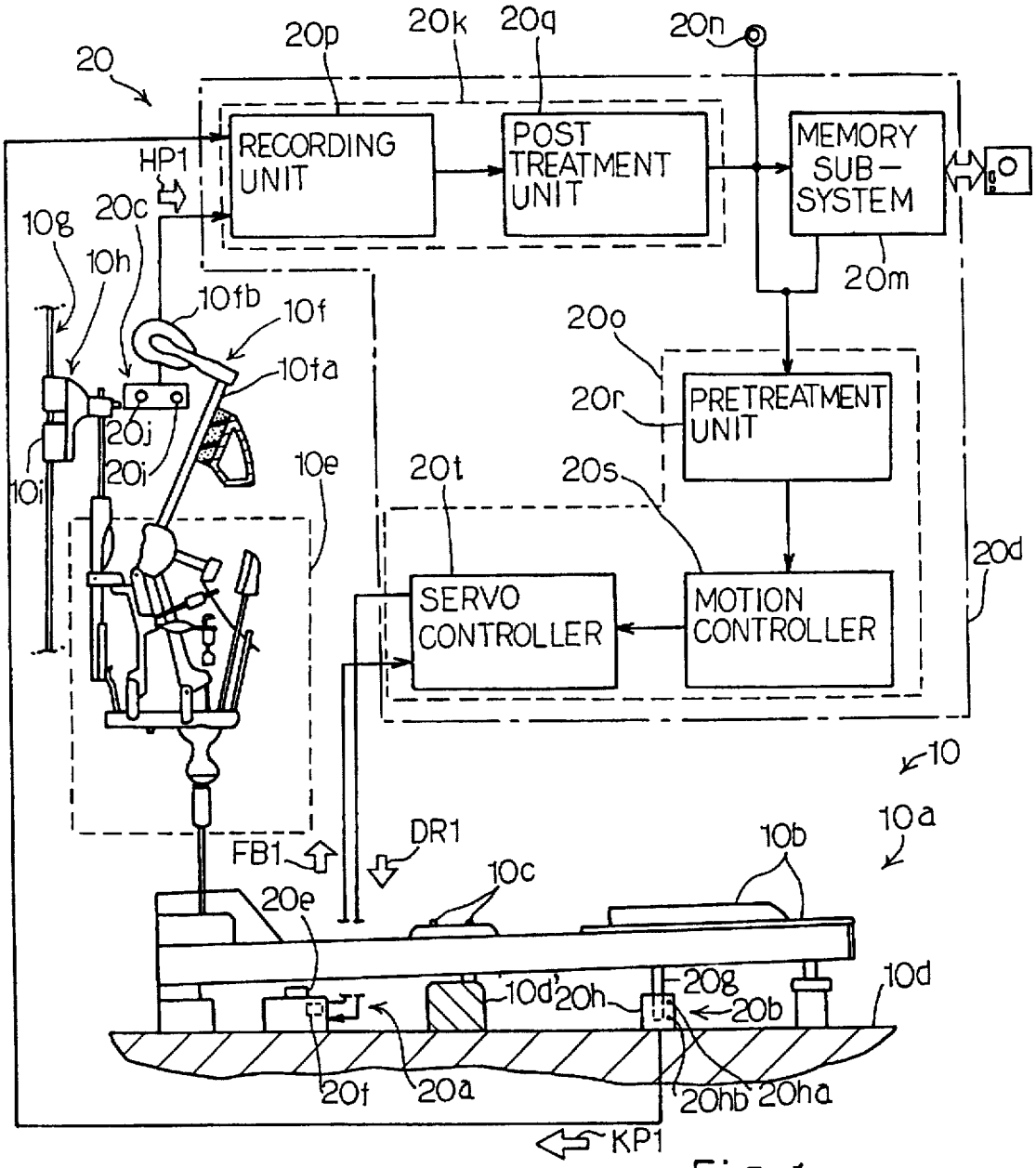
FIG. 1 is a schematic side view showing the structure of an automatic player piano according to the present invention.

Referring first to FIG. 1 of the drawings, an automatic player piano embodying the present invention largely comprises an acoustic piano 10 and an automatic recording/playing system 20. The automatic player piano has at least a recording mode and a playback mode. While a pianist is playing a tune in the recording mode, the automatic recording/playing system 20 produces music data codes representative of the original performance, and stores the music data codes for a playback. On the other hand, the automatic recording/playing system 20 reproduces the original performance in the playback mode.

The acoustic piano 10 is an upright piano, and largely comprises a keyboard **10*a* implemented by a plurality of keys 10*b* each turnably supported by a balance key pin 10*c* on a key bed 10*d*. Each of the keys 10*b* turns between a rest position and an end position around a balance rail 10*d'* when a player depresses it. Notes of a scale are respectively assigned to the keys 10*b*, and key codes respectively represent the notes of the scale. For this reason, every key 10*b*** is identified by using the key code.

The acoustic piano 10 further comprises a plurality of key action mechanisms **10*e* functionally connected to the keys 10*b*, respectively, a plurality of hammer assemblies 10*f* respectively driven for rotation by the key action mechanisms 10*e*, a plurality of sets of strings 10*g* respectively struck by the hammer assemblies 10*f* and a plurality of damper mechanisms 10*h* actuated by the key action mechanisms 10*e* for temporarily leaving damper heads from the associated sets of strings 10*g*. In this instance, each of the keys 10*b*, each of the key action mechanisms 10*e*, each of the hammer assemblies 10*f* and each of the damper mechanisms 10*h* as a whole constitute a striking mechanism, and the plurality of sets of strings 10*g*** serve as a plurality of vibrating means.

The acoustic piano 10 is similar to a standard upright piano, and the key action mechanism **10*e*, the hammer assembly 10*f*, the strings 10*g* and the damper mechanism 10*h*** behave as similar to those of the standard upright piano which are well known to a person skilled in the art. For this reason, no further description is incorporated hereinbelow.

The automatic playing system 20 comprises a plurality of solenoid-operated actuator units **20*a* respectively provided under the keys 10*b*, a plurality of key sensors 20*b* also provided under the keys 10b, a plurality of hammer sensors 20c respectively associated with the hammer assemblies 10f and a controller 20d connected to the solenoid-operated actuator units 20a, the key sensors 20b and the hammer sensors 20c**.

Each of the solenoid-operated actuator units 20a has a plunger 20e protectable and retractable with respect to respective coil units (not shown) and a built-in position sensor 20f. When a driving current signal DR energizes the coil unit, the coil unit causes the plunger 20e to upwardly push the associated key 10b, and the plunger 20e rotates the key 10b from the rest position to the end position. The built-in position sensor 20f monitors the plunger 20e, and generates a feedback signal FB1 indicative of an current position of the plunger 20e. The feedback signal FB1 is supplied to the controller 20d.

Each of the key sensors 20b is implemented by a shutter plate 20g attached to the lower surface of the associated key 10b and a plurality of photo-couplers 20h. A slit pattern (not shown) is formed in the shutter plate 20g, and allows a light beam of the photo-coupler 20h to pass it. The plurality of photo-couplers 20h are provided along the trajectory of the shutter plate 20g, and are spaced by a predetermined distance. In this instance, lower and upper photo-couplers 20ha and 20hb are incorporated in each key sensor 20b, and the lower photo-coupler 20hb is closer to the key bed 10d than the upper photo-coupler 20ha.

When a key 10b is depressed, the shutter plate 20g is downwardly moved together with the key 10b, and sequentially interrupts the optical beam of the upper photo-coupler 20ha and the optical beam of the lower photo-coupler 20hb on the way from the rest position to the end position. When the depressed key 10b is released, the shutter plate 20g is upwardly moved together with the released key 10b, and establishes the optical path of the lower photo-coupler 20hb and, thereafter, the optical path of the upper photo-coupler 20ha. Thus, the shutter plate 20g is moved together with the associated key 10b, and, for this reason, the current position of the shutter plate 20g is equivalent to the current position of the key 10b. The key sensor 20b generates a key position signal KP1 indicative of the current position of the key 10b, and is supplied to the controller 20d. The controller 20d divides a time interval between the upper photo-coupler 20ha and the lower photo-coupler 20hb by the distance between the upper photo-coupler 20ha and the lower photo-coupler 20hb so as to determine a key velocity Vk for the associated depressed key 10b. When the shutter plate 20g interrupts the optical beam of the lower photo-coupler 20hb on the way toward the end position, the controller 20d determines a key depressing time tk.

The shutter plate 20g allows the upper photo-coupler 20ha to pass the slit pattern when the damper assembly 10h comes into contact with the set of strings 10g for absorbing the vibrations. For this reason, the upper photo-coupler 20ha gives the "extinct timing" to the controller 20d, and the controller 20d determines "extinct time" tkN on an absolute time scale from an initiation of a performance. The time interval between the lower photo-coupler 20hb and the upper photo-coupler 20ha is divided by the distance therebetween, and the controller 20d determines the released key velocity VkN.

Each of the hammer sensors 20c is implemented by photo-couplers 20i and 20j. The photo-coupler 20j is closer to the strings 10g than the other photo-coupler 20i, and the photo-coupler 20j is aligned with a rebounding point on the trajectory of the associated hammer assembly 10f. When the hammer shank 10fa arrives at the rebounding point, the hammer head 10fb strikes the strings 10g, and rebounds thereon. For this reason, the "impact timing" is detectable by the associated photo-coupler 20j. Each of the hammer sensors 20c produces a hammer position signal HP1 indicative of a current position of the associated hammer assembly 10f, and supplies the hammer position signal HP1 to the controller 20d. The controller 20d determines an impact time ti representative of the impact timing on the absolute time scale. The photo-coupler 20j is spaced from the photo-coupler 20i by a predetermined distance, and the controller 20d calculates a hammer velocity vH by dividing the time interval between the photo-couplers 20i/20j by the predetermined distance.

In this instance, each of the key sensors 20b and each of the hammer sensors 20c as a whole constitute a monitoring means.

The controller 20d is broken down into a recording sub-system 20k for producing music data codes representative of an original performance on the key board 10a, a memory sub-system 20m for storing the music data codes, a data port 20n for communicating with the outside thereof and a playback sub-system 20o for controlling the solenoid-operated actuator units 20a. The recording sub-system 20k is enabled in the recording mode, and records key/hammer motions in the memory sub-system 20m. On the other hand, the playback sub-system 20o selectively energizes the solenoid-operated actuators 20a in the playback mode, and reproduces the original acoustic sounds.

The recording sub-system 20k has a recording unit 20p responsive to the key position signals KP1 and the hammer position signals HP1 for generating pieces of music data information and a post-treatment unit 20q for normalizing the pieces of music data information. The acoustic piano has its individuality, and the individuality affects the pieces of music data information. If an original performance is recorded by an automatic player piano, the music data codes contain the individuality of the automatic player piano used for the recording. The music data codes are assumed to be supplied to another automatic player piano without the normalization. The different automatic player piano can not faithfully reproduce the original performance due to the difference in the individuality between the different automatic player pianos. A structural difference and a positional difference of the sensors are causative of the individuality, and the post treatment unit 20q eliminates the individuality from the pieces of music data information through a normalization. The pieces of music data information are modified to those of a standard automatic player piano through the normalization. The post treatment unit 20q supplies music data codes representative of the pieces of normalized music data information to the memory sub-system 20m and/or the data port 20n, and the memory sub-system 20m stores the music data codes into a floppy disk, by way of example.

The playback sub-system 20o comprises a pretreatment unit 20r a motion controller 20s and a servo controller 20t. The playback sub-system 20o is responsive to the music data codes supplied from the data port 20n or the memory sub-system 20m so as to reproduce the original acoustic sounds.

The pretreatment unit 20r determines a trajectory of each key to be moved from the music data codes, and the trajectory is represented by a series of position data X). X indicates a target position of the key at time t.

The position data (t, X) is supplied from the pretreatment unit 20o to the motion controller 20s, and the motion controller 20s generates a position control data so as to move the key 10*b* to the target position "X" at time "t". The position control data is supplied to the servo controller 20*t*, and the servo controller 20*t* determines the driving current signal DR1, and supplies it to the solenoid-operated key actuator 20*a* associated with the key 10*b* to be moved. The servo controller 20*t* compares the target position "X" with the current position "X'" represented by the feedback signal FB1, and varies the driving current signal DR1 so as to move the key 10*b* along the trajectory.

Music Data Codes

Subsequently, description is made on pieces of music data information. The recording unit 20*p* generates a piece of music data information on the basis of the key position signal KP1 and the hammer position signal HP1 at every "event", and post treatment unit 20*q* finally forms the piece of or pieces of music data information into a music data code. The term "event" means a single distinguishable motion such as a key depressing, a striking at strings and a key releasing, and a piece of music data information defines an "event" or a single distinguishable motion. A piece of music data information is formed into a music data code. An event in the standard key touch is hereinbelow called as "regular event", and an event in a non-standard key touch is referred to as "irregular event".

While a pianist is playing a tune on the automatic player piano, a plurality of events take place with time during the performance. Time at which an event takes place is hereinbelow called as "event time", and it is necessary to specify the event time for reproducing the event in the playback mode. For this reason, a kind of time information representative of time interval between event times is indispensable for a playback, and an interval data code is periodically inserted into a series of music data codes.

Figure 2A:
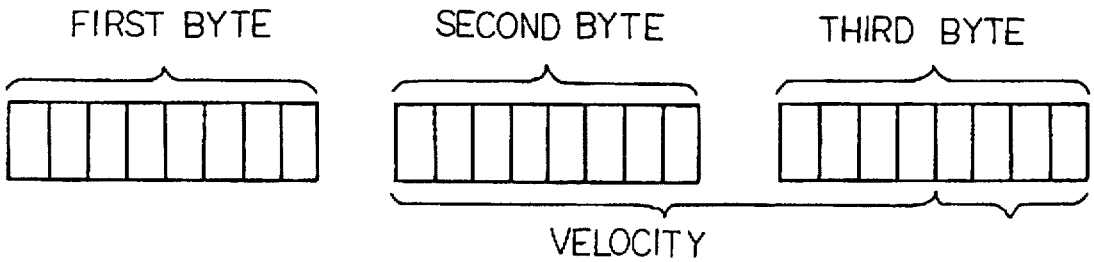
FIG. 2A is a view showing the format of a music data code.

FIG. 2A illustrate the format of the music data code. In this instance, three bytes form the music data code. Although the music data code further contain a bit string representative of a note of a scale assigned to the depressed/released key 10*b* or the key 10*b* associated with the hammer assembly 10*f* striking at the strings 10*g*, the key code is omitted from the format for the sake of simplicity.

The first byte defines the regular event. A key-on event or the key depressing motion, an impact event or the striking motion at strings and a key-off event or the key releasing motion are the regular events. The second byte and higher 4-bits of the third byte define a velocity, and a piece of discriminative information is written into the remaining bits of the third byte so as to indicate whether the event is a regular event or an irregular event. If the remaining bits represent value "0", the event is a regular event. On the other hand, if the remaining bits represent value "8", the event is an irregular event.

Figure 2B:
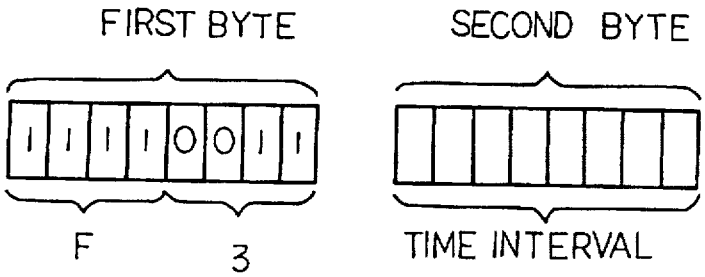
FIG. 2B is a view showing the format of interval data code.

FIG. 2B illustrates the interval data code, and two bytes form the interval data code. The interval data code is specified by the first byte representing value "F3", and the second byte teaches the time interval.

A key-on event takes place at an interruption of the optical beam generated by the lower photo-coupler 20*hb* after the photo-interruption of the optical beam generated by the upper photo-coupler 20*ha*. The recording sub-system 20*k* determines the event time or the key depressing time tk for the key-on event at the interruption of the optical beam generated by the lower photo-coupler 20*hb*.

Figure 2C:
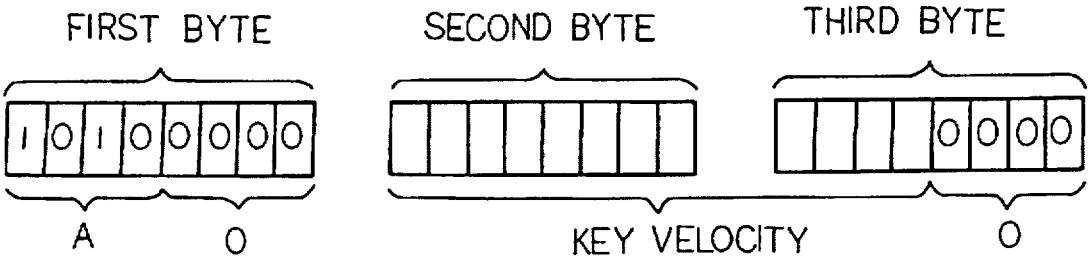
FIGS. 2C to 2E are views showing the music data codes respectively representative of a key depressing event, an impact event and a key releasing event.

FIG. 2C illustrates the music data code representative of a key-on event. The first byte "A0" represents the key-on event, and the key velocity Vk for the depressed key is written into the second byte and the higher 4 bits of the third byte. The discriminative information in the lower 4 bits of the third byte teaches the key-on event to be a regular event.

An impact event takes place at an interruption of the optical beam generated by the photo-coupler 20*j*, and the recording sub-system 20*k* determines an event time or the impact time ti at the interruption of the optical beam generated by the photo-coupler 20*j*.

Figure 2D:
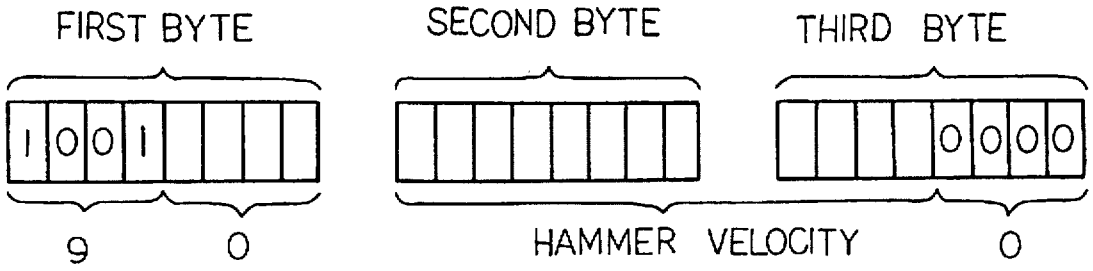

FIG. 2D illustrates the music data code representative of an impact event. Value "90" of the first byte represents the impact event, and the hammer velocity vH is written into the second byte and the higher 4 bits of the third byte. The lower 4 bits of the third byte teach the impact event to be a regular event.

A key-off event takes place at an interruption of the optical beam generated by the upper photo-coupler 20*ha* after the interruption of the optical beam generated by the lower photo-coupler 20*hb*. The recording sub-system 20*k* determines an event time or the extinct time tkN at the interruption of the optical beam generated by the upper photo-coupler 20*ha*.

Figure 2E:
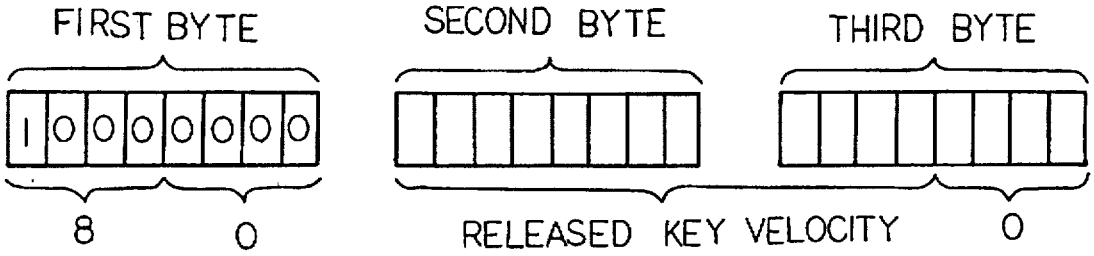

FIG. 2E illustrates the music data code representative of the key-off event. The first byte "80" indicates the key-off event, and the released key velocity VkN is written into the second byte and the higher 4 bits of the third byte. The lower 4 bits of the third byte teach that the key-off event is a regular event.

Figure 3A:
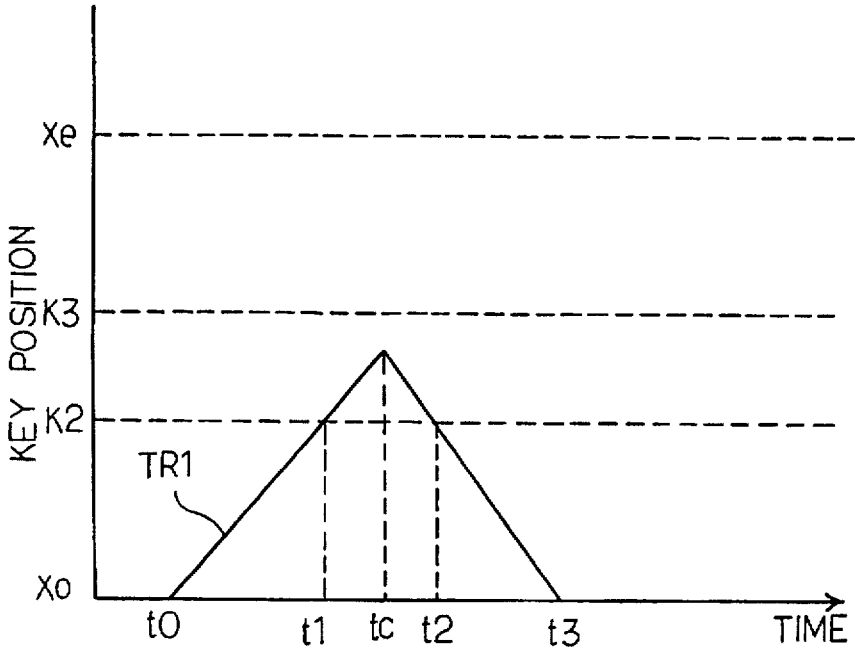
FIG. 3A is a diagram showing a trajectory of a key in a non-standard key touch.

If a pianist releases a depressed key 10*b* on the way from the rest position toward the end position, the key 10*b* traces a trajectory TR1 representative of the non-standard key touch as shown in FIG. 3A. Although an actual trajectory is much complicated, the simplified trajectory TR is convenient for an analysis. The key positions Xe, K3, K2 and Xo represent the end position, the position detected by the lower photo-coupler 20*hb*, the position detected by the upper photo-coupler 20*ha* and the rest position, respectively. The trajectory TR1 teaches that the key 10*b* is downwardly depressed at time t0, passing the key position K2 at time t1, reaching the deepest position between the key positions K2 and K3 at time tc, passing the key position K2 at time t2, again and returning to the rest position Xo at time As described hereinbefore, the key-on event takes place at the interruption of the optical beam of the lower photo-coupler 20*hb* or at the key position K3. For this reason, the key-on event is never acknowledged by the recording sub-system 20*k*. The recording sub-system 20*k* according to the present invention recognizes the key motion along the trajectory TR1 as a missing key-on event. The missing key-on event is discriminative as a key motion causing the shutter plate 20*g* to interrupt the optical beam of the upper photo-coupler 20*ha*, returning toward the rest position Xo without interruption of the optical beam of the lower photo-coupler 20*hb* and causing the shutter plate 20*g* to establish the optical path for the upper photo-coupler 20*ha*. The recording sub-system 20*k* determines an event time for the missing key-on event at time t2 or the key position K2 on the way toward the rest position Xo.

Figure 3B:
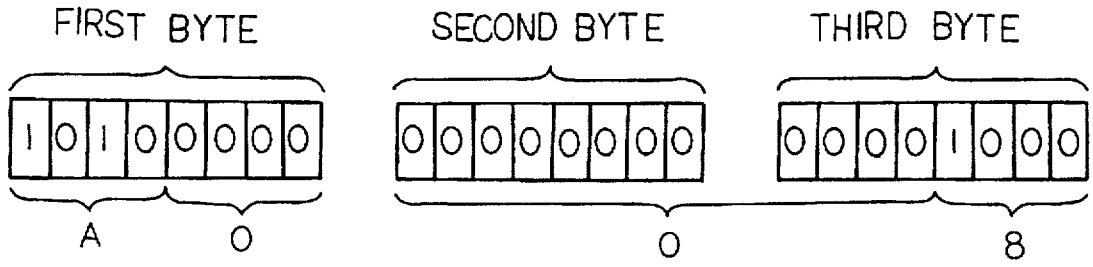
FIG. 3B is a view showing the music data code representative of a missing key-on event.

If the missing keyon event takes place, the recording sub-system 20*k* gives values "A0", "0" and "8" to the music data code as shown in FIG. 3B. Although the first byte of "A0" represents the key-on event, the second byte and the higher 4 bits of the third byte indicate indefinite key velocity, which is represented by "0" in this instance, and the lower 4 bits of the third byte teaches that the keyon event is an irregular event due to the non-standard key touch.

Turning back to FIG. 3A, the depressed key 10*b* starts to return toward the rest position Xo at time tc. As described hereinbefore, the key-off event in the standard key touch takes place in the standard key touch at the establishment of the optical path for the upper photo-coupler 20*ha* after the establishment of the optical path for the lower photo-coupler 20*hb*. For this reason, the key motion shown in FIG. 3A does not result in the key-off event. The recording sub-system 20*k* recognizes the key motion TR1 as a missing keyon-to-keyoff event, and determines time t2 to be an event time for the missing keyon-to-keyoff event. The missing key-on event and the missing keyon-to-keyoff event concurrently take place in an original performance.

Figure 3C:
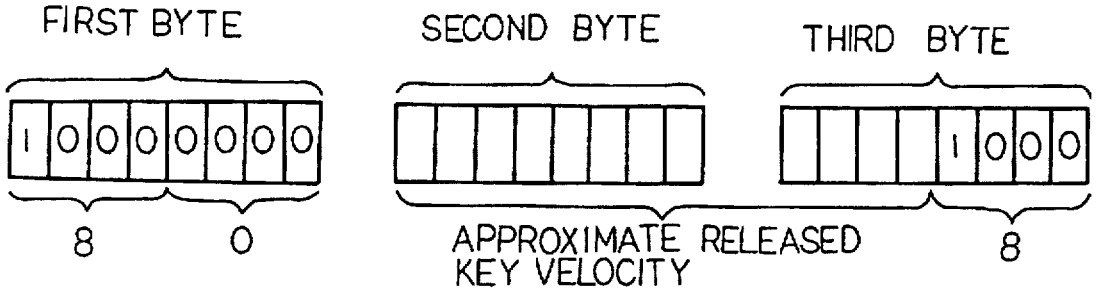
FIG. 3C is a view showing the music data code representative of a missing keyon-to-keyoff event.

When the recording sub-system 20*k* acknowledges the missing keyon-to-keyoff event, value "80", an approximate released key velocity Vn and value "8" are given to the first byte, the second byte/the higher 4 bits of the third byte and the lower 4 bits of the third byte, respectively, as shown in FIG. 3C. Values "80" and "8" indicate the key-off event and the irregular event, i.e., the missing keyon-to-keyoff event, and the approximate released key velocity Vn is given by equation 1.

$$Vn=(K3-K2)/(t2-t1) \qquad \text{Equation 1}$$

where (K3–K2) is the distance between the upper photo-coupler 20*ha* and the lower photo-coupler 20*hb* and (t2–t1) is the time interval between the interruption of the optical beam of the upper photo-coupler 20*ha* and the establishment of the optical path for the upper photo-coupler 20*ha*.

Figure 4A:
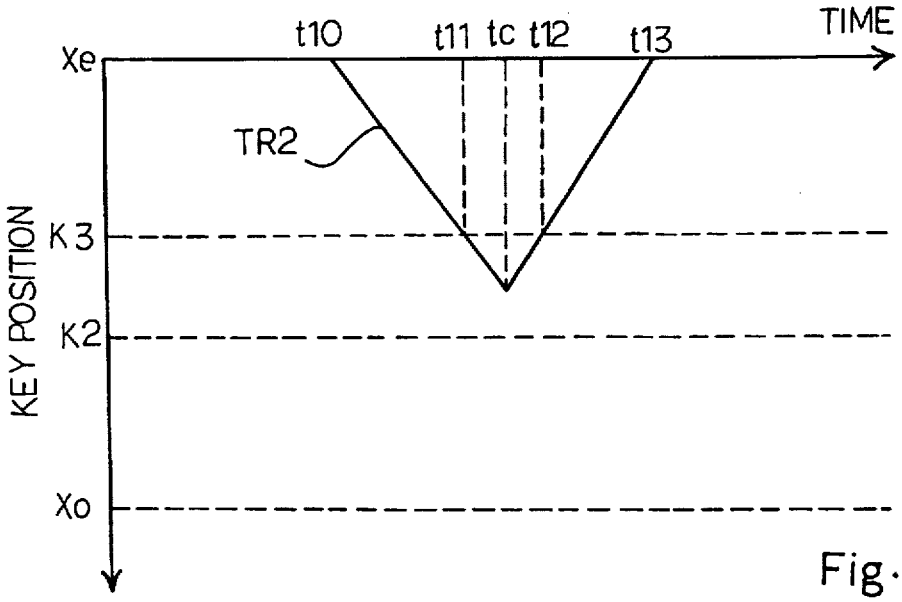
FIG. 4A is a diagram showing a trajectory of a key in another non-standard key touch.

Turning to FIG. 4A, a key 10*b* is moved along another trajectory TR2 due to another non-standard key touch. The key 10*b* is released at the end position Xe at time t10, and the key 10*b* passes the key position K3 at time t11. The pianist depresses the key 10*b* at time tc between the key positions K3 and K2, and the key 10*b* changes the direction of movement. The key 10*b* passes the key position K3 at time t12, and reaches the end position Xe at time t13. The key 10*b* does not pass the key position K2, and, for this reason, the key-off event does not take place. Thus, if the released key 10*b* causes the shutter plate 20*g* to interrupt the optical beam of the lower photo-coupler 20*hb*, again, without establishment of the optical path for the upper photo-coupler 20*ha*, the recording sub-system 20*k* recognizes the key motion as a missing key-off event, and determines time t12 to be an event time for the missing key-off event.

When the recording sub-system 20*k* acknowledges the missing key-off event, the recording sub-system 20*k* gives "80", an indefinite released key velocity and "8" to the first byte, the second byte/higher 4 bits of the third byte and the lower 4 bits of the third byte. In this instance, value "0" represents the indefinite released key velocity.

Thus, the recording sub-system 20*k* discriminates three kinds of key-off event, the key-off event, the missing keyon-to-keyoff event and the missing key-off event. Although the music data codes representative of the three kinds of key-off event have the first byte of "80", the lower 4 bits of the third byte make the missing keyon-to-keyoff event and the missing key-off event discriminative from the key-off event, and the approximate released key velocity Vn makes the missing keyon-to-keyoff event discriminative from the missing key-off event.

If the first byte and the lower 4 bits of the third byte of a music data code respectively have the bit string representative of value "80" and the bit string representative of value "0", the music data code defines the key-off event. If the first byte, the second byte/higher 4 bits of the third byte and the lower 4 bits of the third byte respectively have the bit string representative of "80", the bit string representative of value "0" and the bit string representative of value "8", the music data code defines the missing key-off event. If the first byte, the second byte/higher 4 bits of the third byte and the lower 4 bits of the third byte respectively have the bit string representative of "80", the bit string representative of an integer and the bit string representative of value "8", the music data code defines the missing keyon-to-keyoff event.

Turning back to FIG. 4A of the drawings, the key 10*b* is depressed at an intermediate point between the key positions K3 and K2, and reaches the end position Xe at time t13. However, the later key motion after the missing key-off event does not contain an interruption of the optical beam generated by the upper photo-coupler 20*ha*, and the key-on event does not take place. The recording sub-system 20*k* according to the present invention recognizes the later key motion as a missing keyoff-to-keyon event, and determines time t12 to be an event time for the missing keyoff-to-keyon event. Thus, the missing key-off event and the missing keyoff-to-keyon event concurrently take place.

Figure 4B:
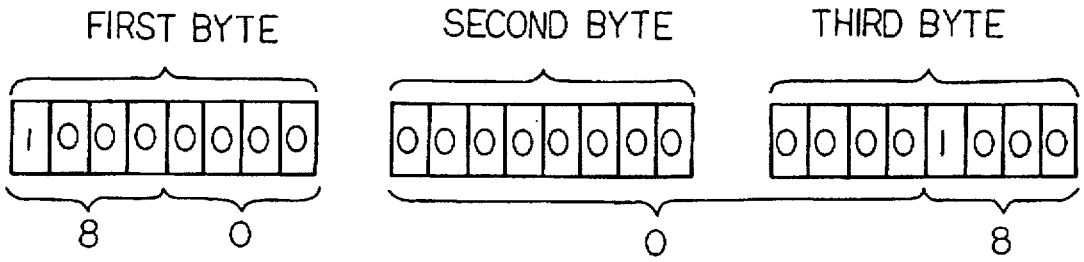
FIG. 4B is a view showing the music data code representative of a missing key-off event.
Figure 4C:
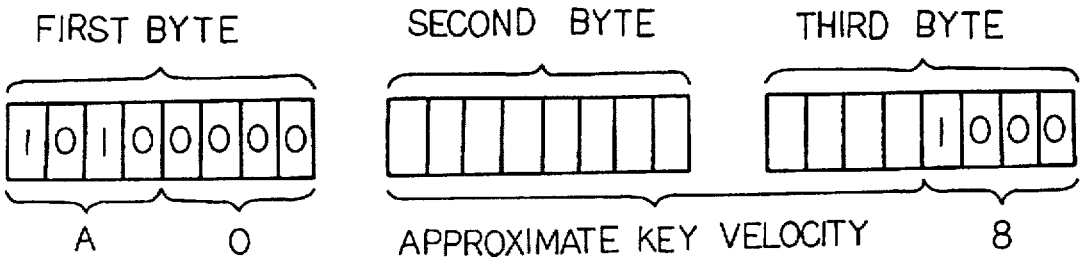
FIG. 4C is a view showing the music data code representative of a missing keyoff-to-keyon event.

When the recording sub-system 20*k* acknowledges the missing keyoff-to-keyon event, the recording sub-system 20*k* gives value "A0", an approximate key velocity and value "8" to the first byte, the second byte/higher 4 bits of the third byte and the lower 4 bits of the third byte, respectively, as shown in FIG. 4C. Comparing the music data code representative of the missing keyoff-to-keyon event (see FIG. 4C) with the music data code representative of the keyon event (FIG. 2C), the first bytes are identical with each other, the key velocity Vk is replaced with an approximate key velocity Vp, and the lower 4 bits of the third byte are different from those of the music data code representative of the missing keyoff-to-keyon event, i.e., value "0" representative of the regular key touch and value "8" representative of the irregular key touch. The approximate key velocity Vp is calculated as follows.

$$Vp=(K3-K2)/(t12-t11) \qquad \text{Equation 2}$$

where (K3–K2) is the distance between the upper photo-coupler 20*ha* and the lower photo-coupler 20*hb* and (t12–t11) is the time interval between the establishment of the optical beam of the lower photo-coupler 20*hb* and the interruption of the optical beam of the lower photo-coupler 20*hb*.

Thus, the three kinds of keyon event are differently coded, and are discriminative on the basis of the bit string of the music data code. Although the three kinds of key-on event are identical in first byte with one another, the key-on event is discriminative from the missing key-on event and the missing keyoff-to-keyon event, because the lower 4 bits of the third byte are different between the music data code representative of the key-on event and the music data codes representative of the missing key-on event and the missing keyoff-to-keyon event. Moreover, the music data code representative of the missing key-on event is identical in the first byte and the lower 4 bits of the third byte with the music data code representative of the missing keyoff-to-keyon event; however, the higher 4 bits of the third byte are difference between the music data code representative of the missing key-on event and the music data code representative of the missing keyoff-to-keyon event, i.e., zero and an integer.

If the first byte and the lower 4 bits of the third byte of a music data code respectively have the bit string representative of "A0" and the bit string representative of value "0", the playback sub-system 20*o* determines the music data code to be representative of the key-on event. If the first byte, the second byte/higher 4 bits of the third byte and the lower 4 bits of the third byte of a music data code respectively have the bit string representative of "A0", the bit string representative of zero and the bit string representative of "8", the playback sub-system 20*o* determines the music data code to be representative of the missing key-on event. The playback sub-system 20o decides a music data code to be representative of the missing keyoff-to-keyon event in so far as the first byte, the second byte/the higher 4 bits and the lower 4 bits have value "A0", an integer and value "8".

Principle of Determination of Trajectory

Subsequently, description is made on the principle of determination of a trajectory in the playback mode.

Using the automatic player piano shown in FIG. 1, the present inventors measured the key velocity and the hammer velocity at the impact against the strings 10g, and noticed that the hammer velocity at the impact was explainable with a key velocity at a special point on the trajectory of a depressed key. Although the special point was variable not only between piano models but also between individual products of the same model, the present inventors found that special points fell within the range between 9.0 millimeters and 9.5 millimeters under the rest positions Xo. Then, the present inventor concluded that, if a key was controlled so as to pass the special point at the key velocity equal to that of an original performance, the hammer would struck the strings at the intensity equal to that in the original performance.

The special point is hereinbelow referred to "reference point Xr", and the key velocity at the reference point Xr is called as "reference velocity Vr".

Figure 5:
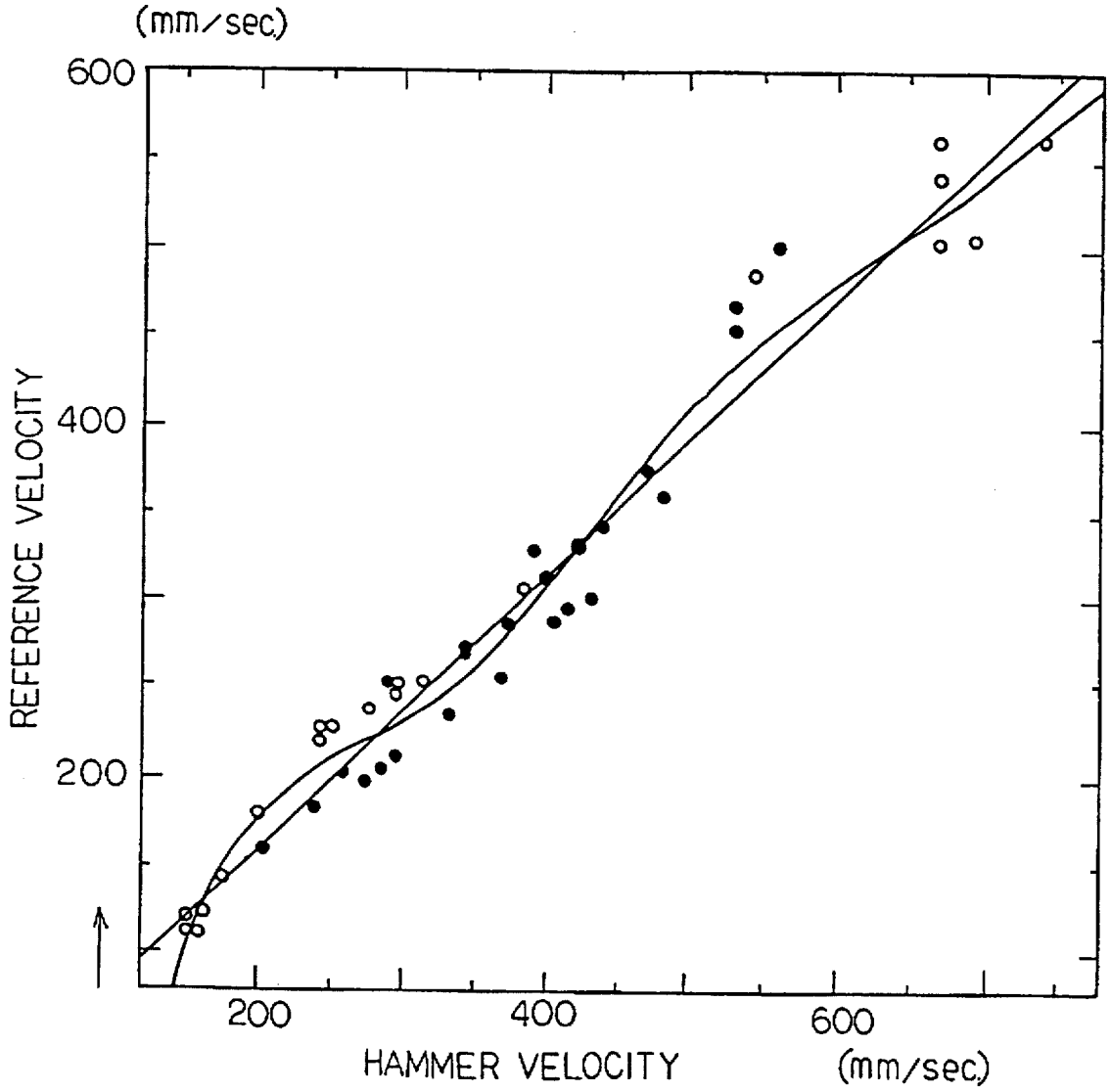
FIG. 5 is a graph showing relation between a reference velocity and a hammer velocity.

The present inventors plotted the hammer velocity vH in terms of the reference velocity Vr in FIG. 5. The reference point Xr was set to 9.5 millimeters below the rest position Xo. Bubbles stand for the hammer velocities when each key was simply depressed from the rest position Xo to the end position Xe. On the other hand, dots represent the hammer velocities measured in repetition where each key returned toward the rest position Xo before reaching the end position Xe.

C1 is indicative of the first-order least square approximation, and C2 is the sixth-order least square approximation. As will be understood, the relation between the reference velocity Vr and the hammer velocity at the impact is well approximated by using the linear line C1 and the non-linear line C2. In other words, it is possible to determine the reference velocity Vr of a key 10b by using the hammer velocity vH of the key 10b in the recording mode. The first-order least square approximation is simple, and less in calculation than another approximation. For this reason, the automatic player piano according to the present invention employs the first-order least square approximation. The reference velocity Vr is calculated as follows.

$$Vr=\text{alpha}\times vH+\text{beta} \qquad \text{Equation 3}$$

where vH is the hammer velocity representative of the intensity of an impact and alpha and beta are constants. The constants alpha and beta are determined through experiments using an actual automatic player piano. The constants alpha and beta are variable depending upon the location of the reference point Xr.

Subsequently, it is necessary for us to determine a reference time tr when a key 10b passes the reference point Xr in the playback. As described hereinbefore, the recording sub-system 20k inserts the interval data codes into a series of music data codes during a recording of an original performance, and the time data code indicates the time interval between two event times. The playback sub-system 20o reads out the interval data codes together with the music data codes in the playback, and accumulates the time intervals so as to form an absolute time scale. The events are reproduced on the absolute time scale in the playback.

Now, we define a reference time interval Tr as "a time interval between the reference time tr and the impact time ti". The photo-coupler 20j is positioned at the rebounding point, and the impact time ti is given by the interval data code associated with the music data code representative of the impact event.

Figure 6:
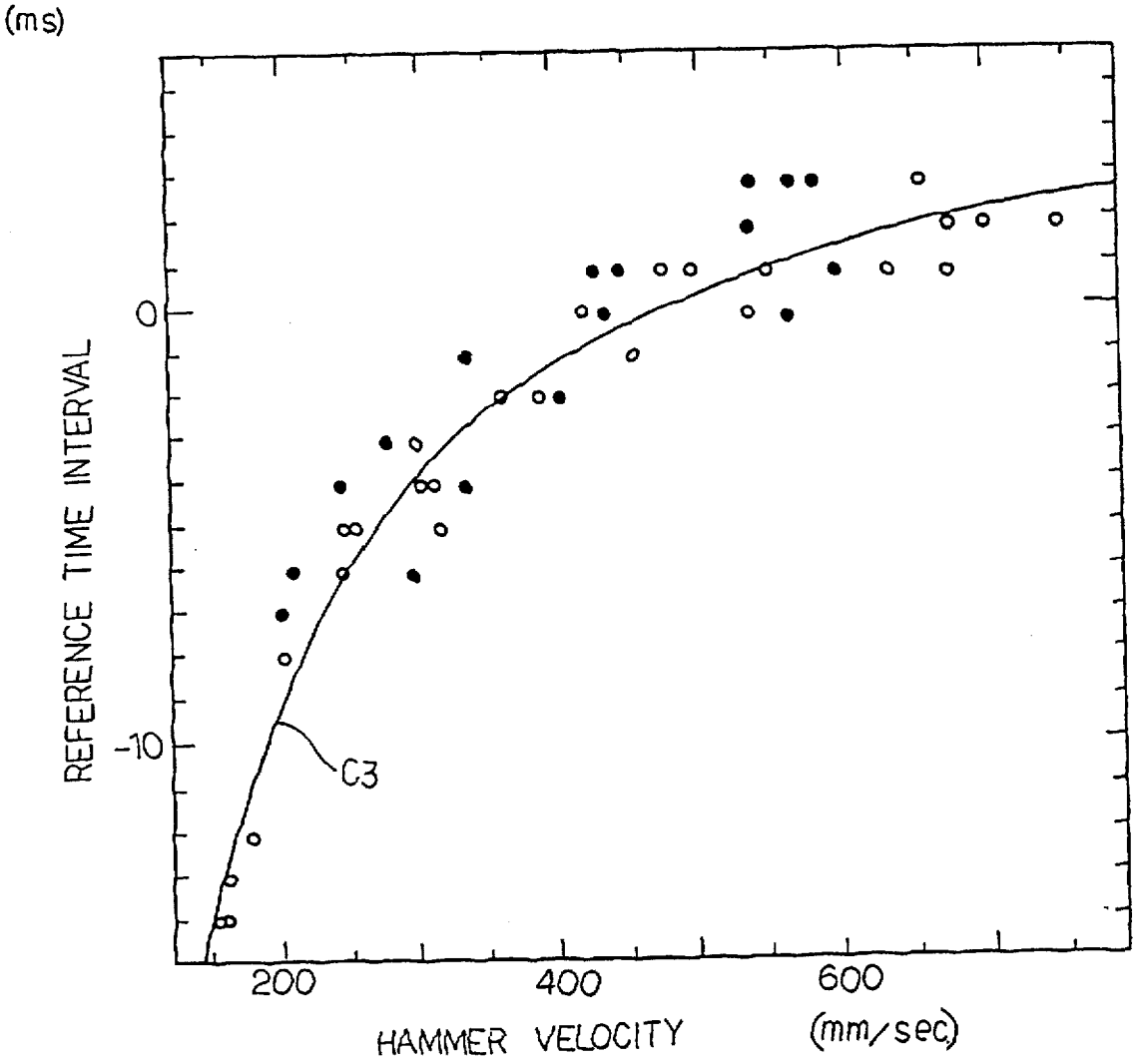
FIG. 6 is a graph showing relation between a reference time interval and the hammer velocity.
Figure 7:
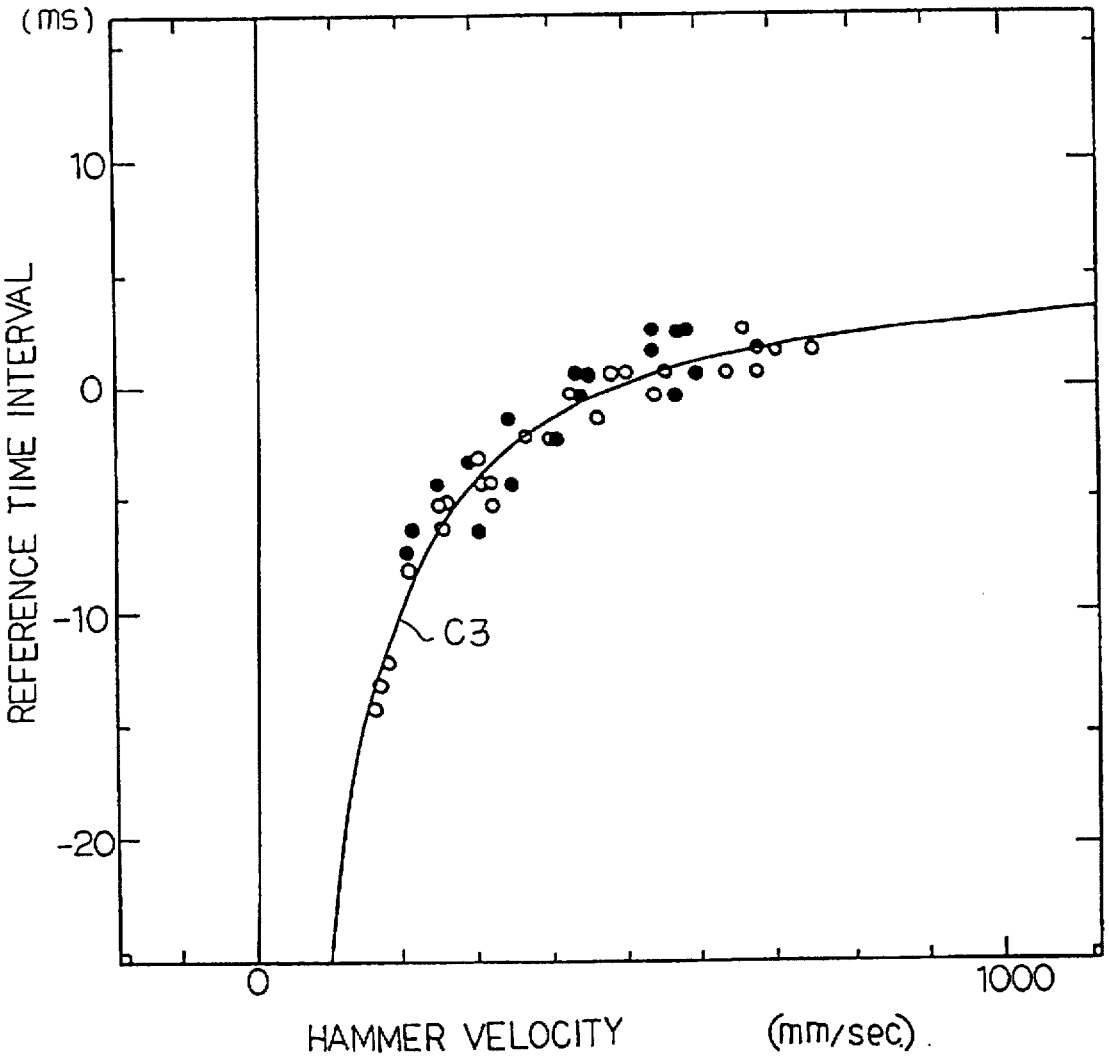
FIG. 7 is a graph showing the relation between the reference time interval and the hammer velocity scaled up at 200 percent.
Figure 8:
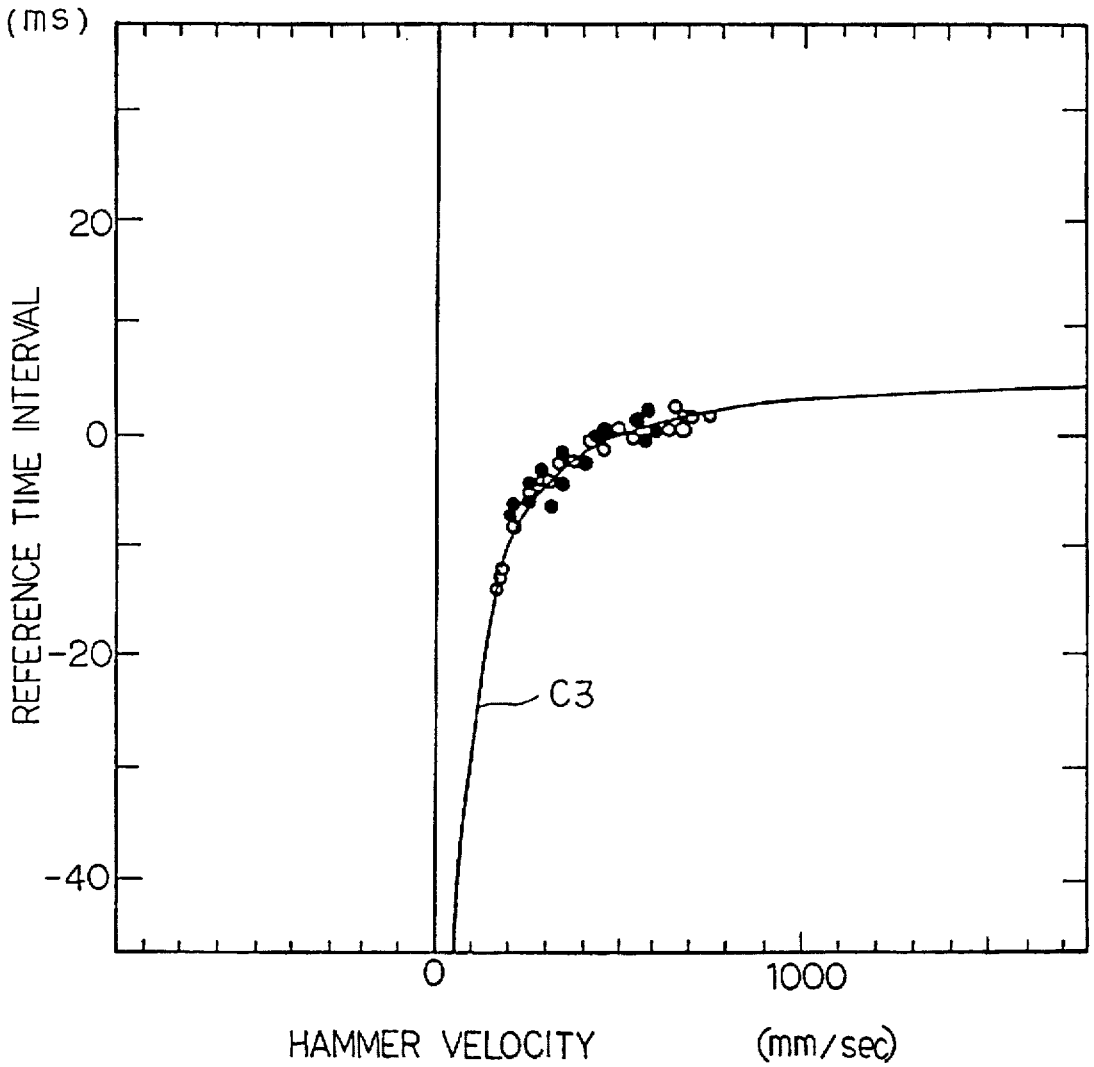
FIG. 8 is a graph showing the relation between the reference time interval and the hammer velocity scaled up at 400 percent.

The present inventors plotted the reference time interval Tr in terms of the hammer velocity vH in FIG. 6. Bubbles stands for the reference time intervals Tr in the simple key motion, and dots represents the reference time intervals Tr in the repetition as similar to FIG. 5. The relation between the reference time interval Tr and the hammer velocity vH is scaled up at 200 percent in FIG. 7, and at 400 percent in FIG. 8. The reference time interval Tr is approximated by a hyperbolic line C3, and is expressed as Equation 2.

$$Tr=-(\text{gamma}/vH)+\text{delta} \qquad \text{Equation 4}$$

where gamma and delta are constants. Gamma and delta are determined through experiments. Constants gamma and delta are variable depending upon the model and the reference point Xr as similar to alpha and beta.

If the reference time interval Tr is calculated by using equation 4, the reference time tr is given by subtracting the reference time interval Tr from the impact time ti on the absolute time scale. If the key 1 is controlled in such a manner as to pass the reference point Xr at the reference time tr at the reference velocity Vr, the intensity of the impact in an original performance is faithfully reproduced in the playback.

If the hammer head 10fb strikes the strings 10g at the reference point Xr, the reference time interval Tr is useless.

Figure 9:
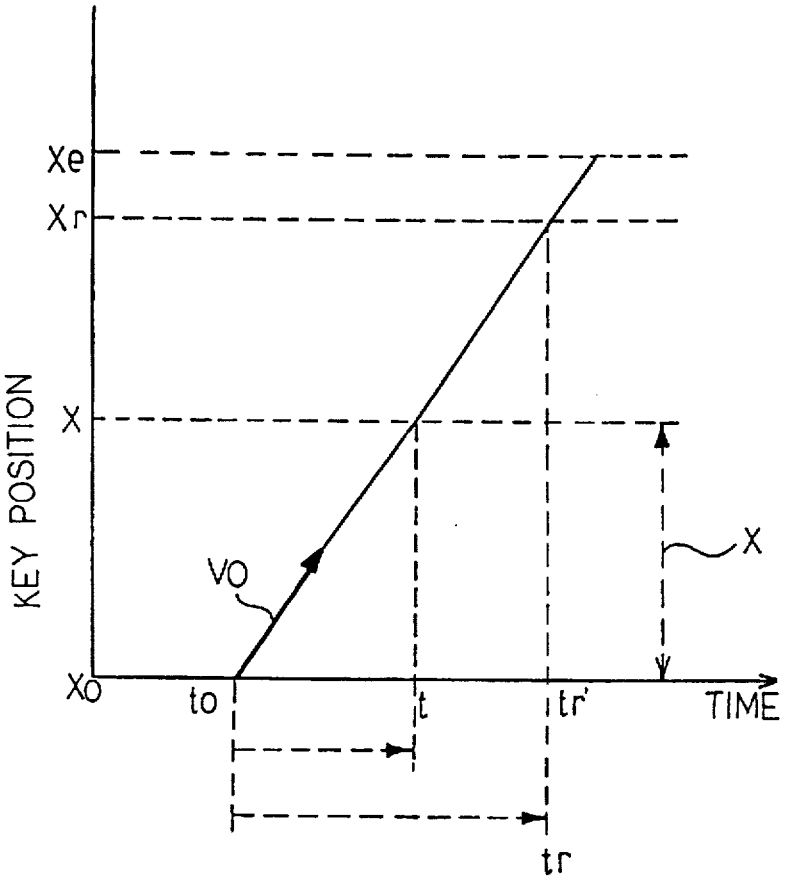
FIG. 9 is a graph showing a trajectory of a depressed key.

The pretreatment unit 20r generates preliminary control data representative of a first trajectory for a depressed key 10b and a second trajectory of the released key 10b as follows. In this instance, the key 10b is assumed to take a uniform motion between the rest position Xo and the end position Xe, and FIG. 9 illustrates the first trajectory. If the key 10b starts the uniform motion from the rest position Xo at time t0, the key 10b is moved toward the end position Xe at a constant speed V0. The key 10b is moved over distance X, and reach key position X at time t. The distance X is expressed by equation 5.

$$X=V0\times t+X0 \qquad \text{Equation 5}$$

The reference point Xr is given as $$Xr=V0\times tr'+X0 \qquad \text{Equation 6}$$

where tr' is a reference time when the key 10b reaches the reference point Xr. Solving Equation 6 for the reference time tr', the reference time tr' is expressed as $$tr'=(Xr-X0)/V0 \qquad \text{Equation 6'}$$

The starting time t0 on the absolute time scale is given by Equation 7 for the depressed key 10b.

$$t0=tr-tr'=tr-(Xr-X0)/V0 \qquad \text{Equation 7}$$

The reference time tr is equal to the difference between the impact time ti and the reference time interval Tr as described hereinbefore.

Therefore, if the associated solenoid-operated actuator unit 20a starts the plunger 20e to upwardly push the associated key 10b at time t0 and moves the key 10b over the distance X along the first trajectory expressed by equation 5, the key 10b reaches the reference point Xr at the reference time tr, and the key velocity at the reference point Xr is equal to the reference velocity Vr.

In this instance, the key 10b is assumed to take the uniform motion, and the playback sub-system 20o controls the key 11b to move at V0 from time t0. The uniform motion makes the reference velocity Vr equal to the constant key velocity V0. The music data code gives the hammer velocity vH to the pretreatment unit 20r, and the reference velocity Vr is calculated by using equation 3. Equation 7 gives the time t0 to the pretreatment unit 20r. Therefore, the pretreatment unit 20r produces the preliminary control data representative of a key motion continued at the constant velocity Vr, and the key 10b starts the rest position Xo at time t0 toward the end position Xe.

The preliminary control data produced by the pretreatment unit 20r are further used for controlling a backward motion after release of the depressed key 10b as follows.

Figure 10:
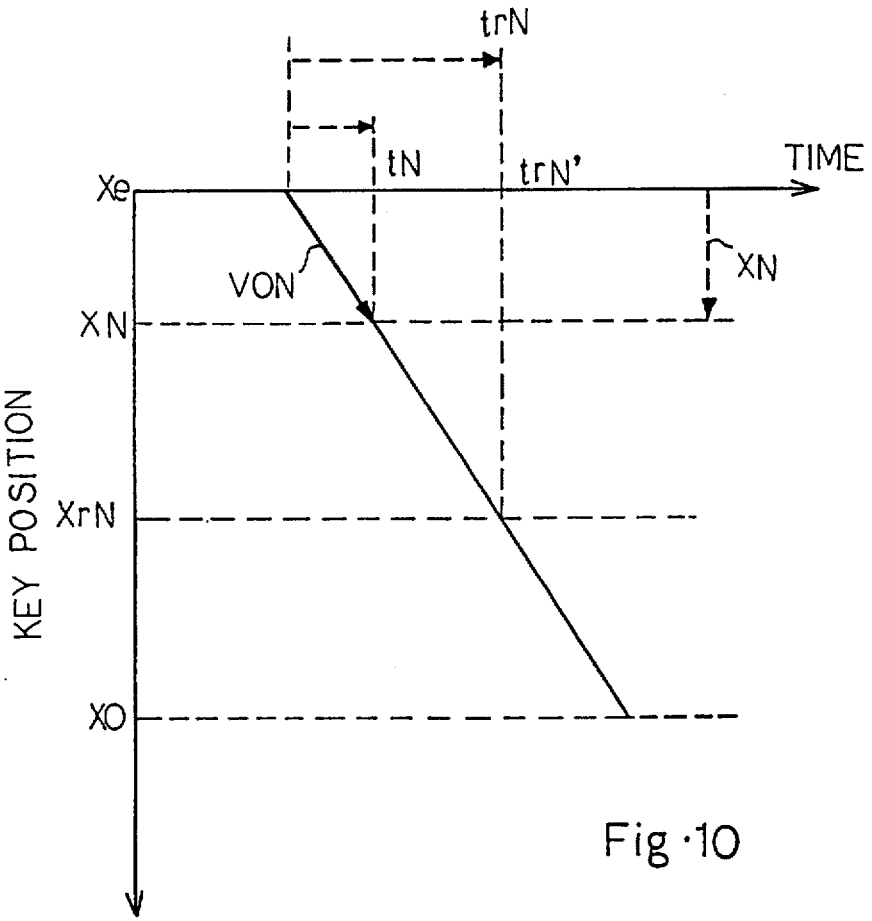
FIG. 10 is a graph showing a trajectory of a released key.

A key position XN at time tN is expressed by equation 8.

$$XN=V0N\times tN+Xe \qquad \text{Equation 8}$$

where V0N is the initial key velocity (<0) at the end position xe. The second trajectory represented by equation 8 is illustrated in FIG. 10 of the drawings. The recording sub-system 20k measures the time period between the establishment of the optical path for the lower photo-coupler 20hb and the establishment of the optical path for the upper photo-coupler 20ha, and divides the distance between the lower photo-coupler 20hb and the upper photo-coupler 20ha by the time period so as to determine the released key velocity VkN. The recording sub-system 20k determines the time at the establishment of the optical path for the upper photo-coupler 20ha to be the extinct time tkN.

As described hereinbefore, the damper head 10i comes into contact with the associated set of strings 10g at the extinct time tkN so as to absorb the vibrations on the strings 10g. Thus, the extinct time tkN is indicative of the timing at which the hammer head 10i extinguishes the acoustic sound, and is detectable with the upper photo-coupler 20ha. The music data code representative of the key-off event defines the released key velocity VkN or the extinction of the acoustic sound, and the associated interval data code specifies the extinct time tkN. The playback sub-system 20o reproduces the released key motion in the playback.

Let us assume that the damper assembly 10h comes into contact with the strings 10g at released reference point XrN on the second trajectory. If the playback sub-system 20o controls a released key 10b in such a manner as to reach the released reference point XrN at the extinct time tkN, it is possible to approximate the decay of the piano sound in the playback to that of the acoustic sound in the original performance.

It is desirable to exactly control the damper velocity at the contact with the strings 10g, because it strongly affects the decay of the tone. The damper velocity is dominated by the released key velocity VkN. For this reason, if the key velocity at the released reference point XrN is adjusted to the released key velocity vkN, the decay of the original piano sound is exactly reproduced in the playback. The key velocity at the released reference point XrN is referred to as "released reference velocity VrN.

If a key 10b is released at time zero, the released reference point XrN is expressed as $$XrN=V0N\times trN'+XeN \qquad \text{Equation 9}$$

where trN' is a time when the released key 10b reaches the reference point XrN. V0N are equal to VrN and VkN, because the key 10b takes the uniform motion. It is possible to determine time trN' by using equation 9, and the starting time t0N is given by equation 10.

$$t0N=trN-trN'=trN-(XrN-XeN)/V0N \qquad \text{Equation 10}$$

The playback sub-system 20o causes the solenoid-operated key actuator 20a to move the released key 10b from the starting time t0 along the second trajectory expressed by equation 8. Then, the released key 10b passes the released reference point XrN at the extinct time tkN. In this instance, the initial key velocity V0N is equal to the reference key velocity vkN, and the reference key velocity vkN is equal to the released reference velocity VrN. If the key 10b is controlled in such a manner as to start with the initial key velocity equal to the released key velocity vkN at time t0, the key 10b similarly behaves.

Figure 11:
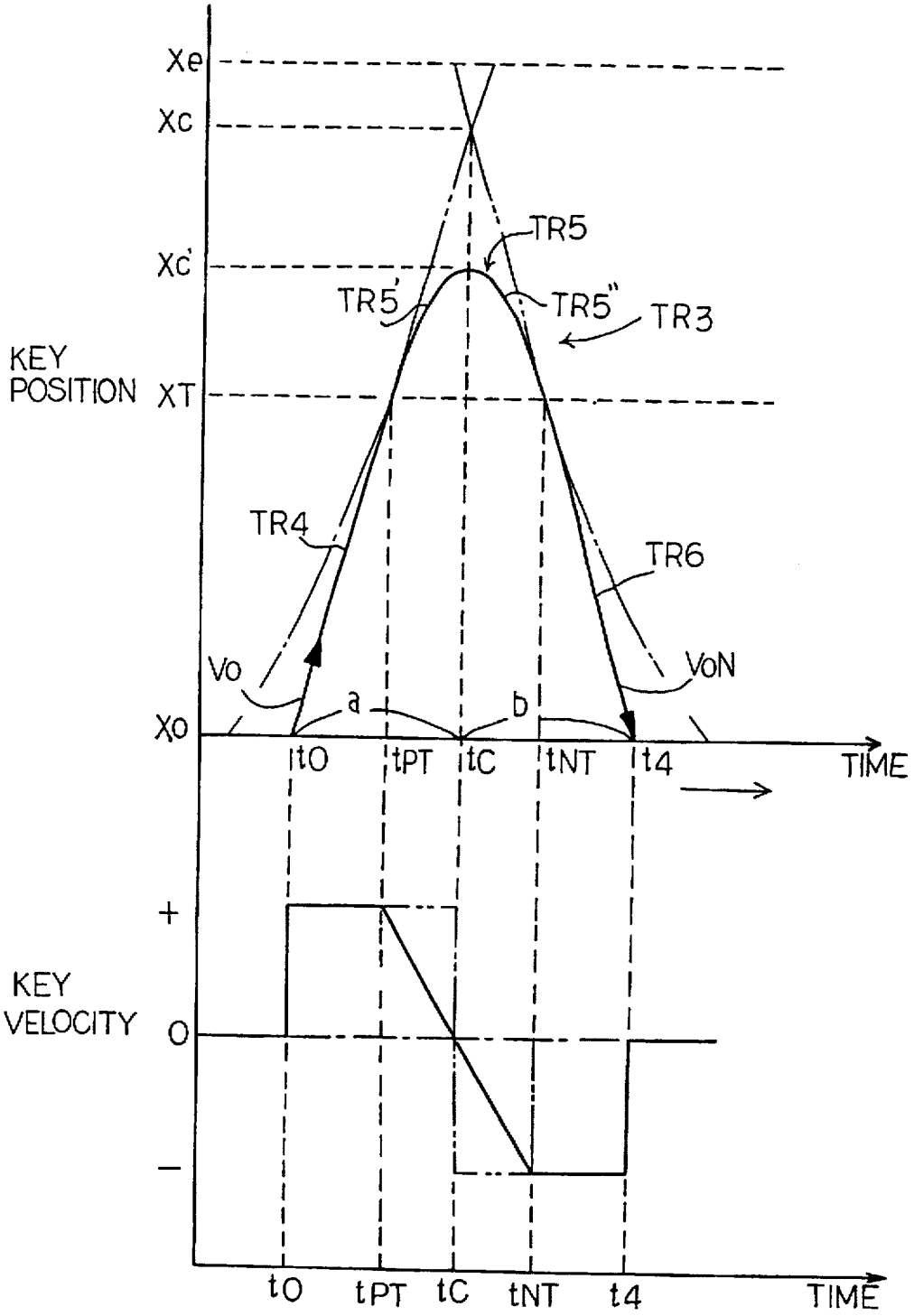
FIG. 11 is a graph showing a composite trajectory of a half stroke key represented by regular events.

Subsequently, description is made on a composite trajectory for a half stroke defined by the regular events. When a key 10b is simply depressed from the rest position Xo to the end position Xe and released from the end position Xe to the rest position Xo, the key 10b is moved along the first trajectory and the second trajectory representative of the uniform motion. If a player releases the key 10b at a certain point Xc' between the rest position Xo and the end position Xe, the half stroke is approximated to a composite trajectory TR3 shown in FIG. 11. The key 10b takes the uniform motion along a first linear trajectory TR4 until a transit point XT, and changes the direction along a transitional trajectory TR5, then taking a second linear trajectory TR6 from the transit point XT to the rest position Xo. The transitional trajectory TR5 is broken down into a decelerating trajectory TR5' and an acceleration trajectory TR5", and the deceleration trajectory TR5' and the acceleration trajectory TR5" are quadratic curves.

The key 10b starts at time t0, and reaches the transit point XT at time tPT. The key 10b turns at point Xc', and restarts the uniform motion from the transit point XT at time tNT. The key 10b returns to the rest position Xo at time t4. The transit point XT is selected in such a manner as to make the key motion natural. If the first linear trajectory TR4 is too short, the reproduction of the key motion becomes unstable. For this reason, the transit point XT is closer to the end position Xe than the mid point between the rest position Xo and the end position Xe.

The composite trajectory TR3 is determined as follows. First, the first linear trajectory TR4 is assumed to cross the second linear trajectory TR6 at a crossing point Xc. If the key 10b is simply depressed and released, the key 10b reaches the crossing point Xc at time tc. The time tc is determined on the basis of the data representative of the first linear trajectory TR4 and the second linear trajectory TR6. The velocity of the key 10b is zero at time tc, and the decelerating trajectory TR5' and the acceleration trajectory TR5" are led from following boundary conditions. While the key 10b is traveling from the transit point XT to a turning point Xc', the key velocity is decreased from an initial key velocity Vo to zero, and the deceleration consumes time from tPT to tc. On the other hand, while the key 10b is being accelerated from tc to tNT, the key velocity is increased from zero to VoN.

First, the time tc is calculated as follows. The key 10b consumes time a from the rest position Xo at t0 to the turning point Xc' at tc and time b from the turning point Xc' to the rest position Xo at t4. Then, the relation between the key velocity and the time period is expressed by equation 11.

$$Vo\times a=-VoN\times b \qquad \text{Equation 11}$$

The time periods a and b satisfy equation 12.

$$a+b=t4-t0 \quad \text{Equation 12}$$

From equation 11 and 12, the time period a is given by equation 13.

$$a=VoN(t4-t0)/(VoN-Vo) \quad \text{Equation 13}$$

The time tc is expressed by equation 14.

$$\begin{aligned} tc &= t0+a \\ &= t0+VoN(t4-t0)/(VoN-Vo) \\ &= (VoN\times t4-Vo\times t0)/(VoN-Vo) \end{aligned} \quad \text{Equation 14}$$

The time t4 is expressed as $$t4=toN-(Xe-Xo)/VoN \quad \text{Equation 15}$$

Acceleration aP between time tPT and time tc is calculated as follows.

$$aP=-Vo/(tc-tPT) \quad \text{Equation 16}$$

The time tPT is given by equation 17.

$$tPT=t0+(XT-Xo)/Vo \quad \text{Equation 17}$$

The acceleration aP has a negative value, and the key velocity on the decelerating trajectory TR5' is expressed by equation 18.

$$V=Vo+aP(t-tPT) \quad \text{Equation 18}$$

An arbitrary key position X on the decelerating trajectory TR5' is expressed by equation 19.

$$X=P1\ t^2+Q1\ t+R1 \quad \text{Equation 19}$$

where P1, Q1 and R1 are constants and t is time on the absolute time scale. The constants P1, Q1 and R1 are determined by substituting values on the absolute time scale shown in FIG. 11 for t of equation 19 and a derivative of equation 19. The quadratic function expressed by equation 19 has the gradient Vo at time tPT and the gradient of zero at time tc, and has value XT at time tPT. When substituting these values for time t, we obtain the constants P1, Q1 and R1.

The acceleration aN on the accelerating trajectory TR5" is calculated as follows. The acceleration aN is given by equation 20.

$$aN=VoN/(tNT-tc) \quad \text{Equation 20}$$

The time tNT is given by equation 21.

$$tNT=t4+(XT-Xo)/VoN \quad \text{Equation 21}$$

Equation 22 gives the key velocity V on the accelerating trajectory TR5", and equation 23 expresses an arbitrary key position XN on the accelerating trajectory TR5".

$$V=aN(t-tc) \quad \text{Equation 22}$$

$$XN=P2\ t^2+Q2\ t+R2 \quad \text{Equation 23}$$

where R2, Q2 and R2 are constants. Substituting specific values on the absolute time scale shown in FIG. 11 for t of equation 23 and a derivative of equation 23, then we obtain the constants R2, Q2 and R2. Equation 23 expresses a quadratic function having gradients VoN at tNT and zero at tc, and has value XT at tNT. The maximum value of equation 23 is equal to the maximum value of equation 19, and the quadratic function expressed by equation 23 is connected to the quadratic function expressed by equation 19 at tc. The turning point Xc' is the junction between these quadratic functions.

Thus, the playback sub-system 20*o* determines the composite trajectory TR3 on the basis of the music data codes representative of the regular events, i.e., the key-on/key-off events, and reproduce the half-stroke key in the playback.

However, when the music data codes representative of the irregular events are read out, the music data codes do not have the key velocity Vk and the released key velocity VkN, and the playback sub-system 20*o* can not determine a composite trajectory TR3, because equations 5, 8, 19 and 23 are not available. Moreover, when regular key-on/key-off events did not result in an impact event in an original performance, it is desirable to reproduce the key motion without a strike at the strings 10*g* in the playback. For this reason, the playback sub-system 20*o* carries out the following data processing for irregular key motions.

Figure 12:
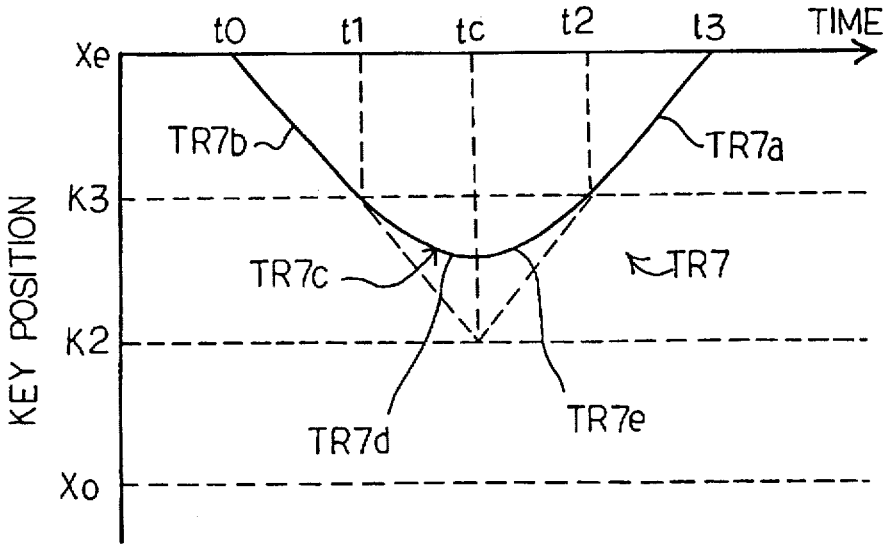
FIG. 12 is a graph showing a composite trajectory of a non-standard key touch called as a deep repetition.

FIG. 12 illustrates one of the non-standard key touch along a composite trajectory TR7. The key 10*b* is released at the end position Xe at t0, and passes the key position K3 at t1. The key 10*b* is depressed on the way from the key position K3 to the key position K2 again, and the key position becomes closest to the rest position Xo at tc. The key 10*b* passes the key position K3 at time t2, and reaches the end position Xe at t3, again. The key 10*b* causes the hammer head 10*fb* to strike the strings 10*g* before t2.

The recording sub-system 20*k* firstly acknowledges the missing key-off event and the missing keyoff-to-keyon event at t2, and, thereafter, the impact event. The impact event, the missing key-off event and the missing keyon-to-keyoff event have respective bit strings represented as follows. A pair of brackets "[ ]" and a pair of parentheses "( )" stand for a music data code and a byte, respectively.

Time interval: [(F 3) (T T)]

Missing key-off event: [(8 0) (0 0) (0 8)]

Missing keyoff-to-keyon event: [(A 0) (Vp Vp) (Vp 8)]

Impact event: [(9 0) (vH vH) (vH 0)]

The playback sub-system assumes the trajectory TR7 to be dividable into the section between t0 to t1, the section between t1 and t2 and the section between t2 and t3, and determines a downward linear sub-trajectory TR7*a* between t2 and t3, an upward linear sub-trajectory TR7*b* between time t0 and t1 and a transitional sub-trajectory TR7*c* between t1 and t2 as follows.

The key 10*b* passes the key position K3 at t2, and the playback sub-system 20*o* determines a key position X on the downward linear sub-trajectory TR7*a* at t by using equation 24.

$$X=V0\ (t-t2)+K3 \quad \text{Equation 24}$$

where V0 is the initial key velocity. The key 10*b* is assumed to take a uniform motion, and the initial key velocity V0 is equal to the reference key velocity Vr. The playback sub-system 20*o* extracts the reference key velocity Vr and time t2 from the music data codes, and determines the downward linear sub-trajectory TR7a between t2 and t3.

In detail, the interval data code defines the time interval between the impact event and the missing keyoff-to-keyon event. Though not shown, another interval data code is placed before the music data code representative of the impact event, and the playback sub-system 20*o* accumulates all the time intervals from the initiation of the playback so as to determine time t2 on the absolute time scale. The music data code representative of the impact event contains the hammer velocity vH, and equation 3 defines the relation between the hammer velocity vH and the reference key velocity Vr. The playback sub-system 20o calculates the reference velocity Vr by using equation 3. When the absolute time t2 and the reference key velocity Vr are determined, the playback sub-system 20o obtains a series of key position X or the downward linear sub-trajectory by using equation 24.

The playback sub-system 20o determines the upward linear sub-trajectory TR7*b* as follows. The key 10b passes the key position K3 at t1, and will pass the key position K at tc. The key 10b starts with an initial key velocity VN, and an arbitrary key position XN on the upward linear sub-trajectory TR7*b* is given by equation 25.

$$XN=(K2-K3)(t-tc)/(tc-t1)+K2 \quad \text{Equation 25}$$

The upward linear sub-trajectory TR7*b* crosses the downward linear sub-trajectory TR7*a* at tc, and the key position X=K2 at tc satisfies equation 24. The initial key velocity is equal to the reference key velocity Vr. Therefore, $$tc=(K2-K3)/Vr+t2 \quad \text{Equation 26}$$

The approximate key velocity Vp in the missing keyoff-to-keyon event is given by equation 2. Solving equation 2 for t1. We obtain equation 27.

$$t1=t2-(K3-K2)/Vp \quad \text{Equation 27}$$

From equations 25, 26 and 27, we obtain equation 28.

$$XN=1/(1/Vr-1/Vp)(t-tc)+K2 \quad \text{Equation 28}$$

The reference key velocity Vr, the approximate key velocity Vp and the key position K2 are known, and equation 26 gives time tc. Therefore, equation 28 determines an arbitrary key position XN on the upward linear sub-trajectory TR7*b*.

A transitional sub-trajectory is assumed to link the upward linear sub-trajectory TR7*b* and the downward linear sub-trajectory TR7*a* with each other in the irregular key motion. The transitional sub-trajectory TR7*b* is also broken down into a decelerating section TR7*d* and an accelerating section TR7*e*. The decelerating section TR7*d* is merged with the accelerating section TR7*e* at tc, and the key velocity at tc is zero. The key 10b gradually varies the key velocity from VON, which is less than zero, to zero between t1 and tc along the decelerating section TR7*d*, and from zero to V0 between tc and t2 along the accelerating section TR7*e*.

The acceleration aN on the decelerating section TR7*d* is given by equation 29.

$$aN=-V0N/(tc-t1) \quad \text{Equation 29}$$

The released key velocity V at arbitrary time t is expressed as follows.

$$V=V0N+aN(t-t1) \quad \text{Equation 30}$$

Equation 31 gives an arbitrary key position X on the decelerating section TR7*d*.

$$X=P3\ t^2+Q3\ t+R3 \quad \text{Equation 31}$$

where P3, Q3 and R3 are constants. Substituting specific times and its key position/key velocities in FIG. 12 into equation 31 and a derivative of equation 31 yield the constants P3, Q3 and R3. These specific times and its key positions are K3 at t2, V0N at t1 and zero at tc.

Subsequently, the acceleration aP on the accelerating section TR7*e* is given by equation 32.

$$aP=V0/(t2-tc) \quad \text{Equation 32}$$

The key velocity V on the accelerating section TR7*e* is expressed as $$V=aP(t-tc) \quad \text{Equation 33}$$

Equation 34 gives the key position at an arbitrary time t on the accelerating section TR7*e*.

$$X=P4\ t^2+Q4\ t+R4 \quad \text{Equation 34}$$

where P4, Q4 and R4 are constants given by substituting specific times t2/tc and its key position/key velocities K3, V0 and zero into equation 34 and a derivative of equation 34.

In this way, the playback sub-system 20o determines the transitional sub-trajectory TR7*c*, and completes the composite trajectory TR7 for the non-standard key touch.

Figure 13:
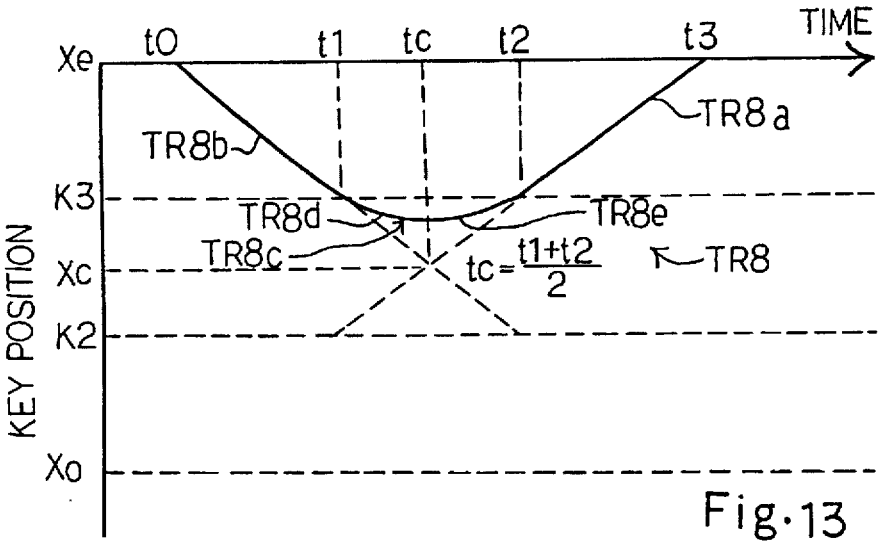
FIG. 13 is a graph showing a composite trajectory of a silent note.

Another non-standard key touch to be reproduced is the silent note, i.e., spacing the damper head 10i from the strings 10g without a strike. FIG. 13 illustrates a composite trajectory TR8 of the silent note. The key 10b is released at t0, and passes the key position K3 at t2. The key 10b changes the direction of motion at tc, and passes the key position K3 without reaching the key position K2. The key 10b finally reaches the end position at t3. While the key 10b is tracing the composite trajectory TR8, the associated hammer head 10fb does not strike the strings 10g. Then, the recording sub-system acknowledges the missing released event and the missing keyoff-to-keyon event at t2, and stores the following music data codes in the memory sub-system 20m.

Time interval: [(F 3) (T T)]

Missing key-off event: [(8 0) (0 0) (0 8)]

Missing keyoff-to-keyon event: [(A 0) (Vp Vp) (Vp 8)]

The playback sub-system assumes the trajectory TR8 to be dividable into the section between t0 to t1, the section between t1 and t2 and the section between t2 and t3, and assigns a downward linear sub-trajectory TR8*a* to the section between t2 and t3, upward linear sub-trajectory TR8*b* to the section between time t0 and t1 and a transitional sub-trajectory TR8*c* to the section between t1 and t2 as follows. The silent note does not contain an impact event, and, accordingly, the music data codes for the silent note do not contain the hammer velocity vH.

As to the downward linear sub-trajectory TR8*a*, the key 10b starts the key motion at K3 at time t2, and reaches the end position Xe at t3. Although the hammer velocity vH is unknown, the music data code representative of the missing keyoff-to-keyon event gives the approximate key velocity Vp to the playback sub-system 20o, and the playback sub-system 20o determines a key position X on the downward linear sub-trajectory TR8*a* at t by using equation 35.

$$X=-Vp(t-t2)+K3 \quad \text{Equation 35}$$

The time interval gives time t2 on the absolute time scale to the playback sub-system 20o, and the lower photo-coupler 20hb gives a specific value of the key position K3.

The playback sub-system 20o determines the upward linear sub-trajectory TR8*b* as follows. The playback sub-system 20o substitutes the approximate key velocity Vp for the released key velocity on the upward linear sub-trajectory TR8*b*. An arbitrary key position XN on the upward linear sub-trajectory TR8*b* is given by equation 36.

$$XN=Vp(t-t1)+K3 \quad \text{Equation 36}$$

The approximate key velocity Vp and the key position K3 are known, and equation 27 gives specific value of time t1 to the playback sub-system 20*o*.

The transitional sub-trajectory TR8*c* is determined on the assumption that the key velocity is zero at time tc. The key 10*b* is decelerated from V0N (<0) to zero between t1 and tc, and is accelerated from zero to V0 between tc to t2. A part of the transitional sub-trajectory TR8*c* between t1 and tc is referred to as a decelerating section TR8*d*, and an accelerating section TRSe indicates another part of the transitional sub-trajectory TR8*c* between tc and t2.

First, the playback sub-system 20*o* calculates time tc from equations 35 and 36. The time tc and the key position Xc at time tc are $$tc=(t1+t2)/2 \quad \text{Equation 37}$$

$$Xc=(K2+K3)/2 \quad \text{Equation 38}$$

The time tc is the mid point between t1 and t2, because the missing key velocity Vp is substituted for the key velocity and the released key velocity.

Using tc given by equation 37, equations 31 and 34 give the decelerating section TR8*d* and the accelerating section TR8*e*. The upward linear sub-trajectory TR8*b*, the transitional sub-trajectory TR8*c* and the downward linear sub-trajectory TR8*a* are linked with one another, and form the composite trajectory TR8.

Figure 14:
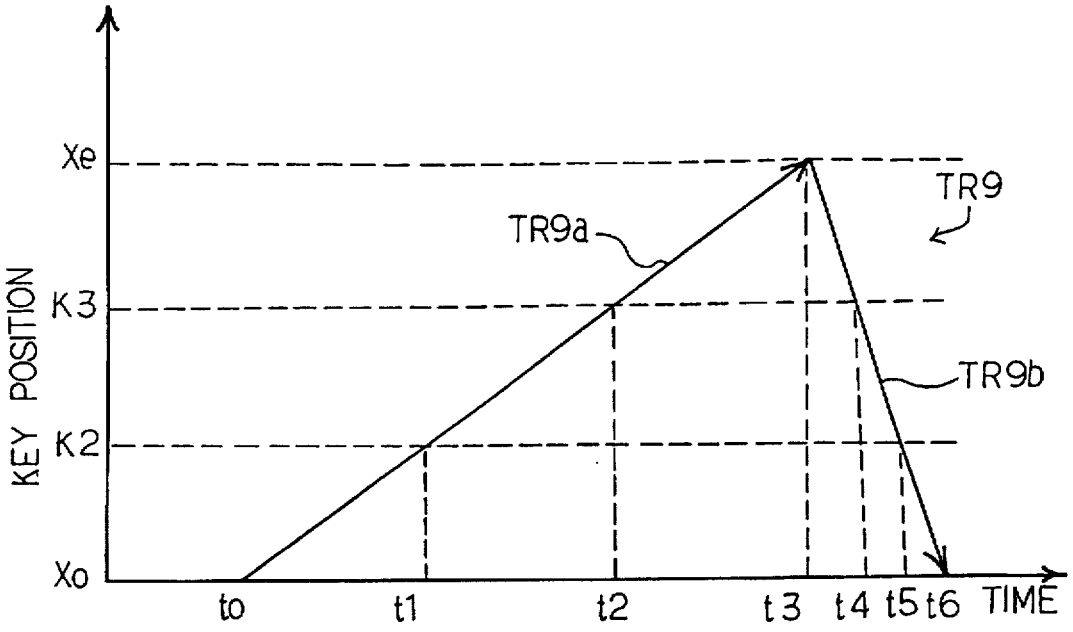
FIG. 14 is a graph showing reciprocal trajectory of another silent note.

When a pianist slowly depresses a key 10*b* from the rest position Xo to the end position Xe, the silent note takes place, and FIG. 14 illustrates a reciprocal trajectory TR9 of the silent note. The key 10*b* starts the rest position Xo at time t0, and successively passes the key position K2 at time t1 and the key position K3 at time t2. The key 10*b* reaches the end position Xe at time t3. The key 10*b* leaves the end position Xe at time t3, and successively passes the key position K3 at time t4 and the key position K2 at time t5. The released key 10*b* reaches the rest position Xo at time t6. Although the key 10*b* is assumed to take a uniform motion between the rest position Xo and the end position Xe, the key velocity is extremely small from the rest position Xo to the end position Xe, and has a standard value from the end position Xe to the rest position Xo. Force is transferred from the key 10*b* through the key action mechanism 10*e* to the hammer assembly 10*f*; however, the force is too small to make the hammer head 10*fb* strike the strings 10*g*. For this reason, no acoustic sound is generated, and the silent note is represented by the following music data codes.

Time interval: [(F 3) (T T)]

Key-on event: [(A 0) (Vk Vk) (Vk 0)]

Time interval: [(F 3) (T T)]

Key-off event: [(8 0) (VkN VkN) (VkN 0)]

Thus, the music data code representative of the impact event is not incorporated.

In order to reproduce the silent note, the playback sub-system determines a downward sub-trajectory TR9*a* from the key velocity Vk and the key depressing time tk at K3, and an upward sub-trajectory TR9*b* from the released key velocity VkN and the extinct time tkN at K2.

Thus, the playback sub-system 20*o* according to the present invention reproduces the non-standard key touches by virtue of the recognition of the missing key-on event, the missing keyon-to-keyoff event, the missing key-off event and the missing keyoff-to-keyon event.

Behavior of Automatic Player Piano

The automatic player piano behaves in the recording mode as follows. While a pianist is playing a tune on the keyboard 10*a*, the key sensors 20*b* and the hammer sensors 20*c* monitor the associated keys 10*b* and the associated hammer assemblies 10*f*, and supplies the key position signals KP1 and the hammer position signals HP1 to the recording unit 20*p*. The recording unit 20*p* cooperates with the post treatment unit 20*q*. The recording unit 20*p* and the post treatment unit 20*q* generates the music data codes representative of the events and the interval data codes each representative of a time interval between two events.

When the pianist simply depresses a key 10*b* at the rest position Xo and releases it at the end position Xe, the key 10*b* takes the regular key motion, and the recording unit/post treatment unit 20*p*/20*q* generate the music data code representative of the keyon event together with the interval data code, the music data code representative of the impact event together with the interval data code and the music data code representative of the key-off event accompanied with the interval data code.

When the pianist depresses or releases a key 10*b* in a non-standard key touch, the recording unit/post treatment unit 20*p*/20*q* generate the music data code representative of the missing key-on event/missing keyon-to-keyoff event or the missing key-off event/missing keyoff-to-keyon event with or without the interval data code. If the non-standard key touch results in an acoustic sound, the recording unit/post treatment unit 20*p*/20*q* further generate the music data code representative of the impact event. However, if the non-standard key touch is the silent note, the recording unit/post treatment unit 20*p*/20*q* do not generate the music data code representative of the impact event.

In this way, the recording unit/post treatment unit 20*p*/20*q* generates a series of music data codes/interval data codes representative of the original performance, and the series of music data codes/interval data codes is written into the memory sub-system 20*m*. If the pianist wants to the original performance through another musical instrument in a real time manner, the series of music data codes/interval data codes is transferred through the data port 20*n* to the musical instrument.

Figure 15:
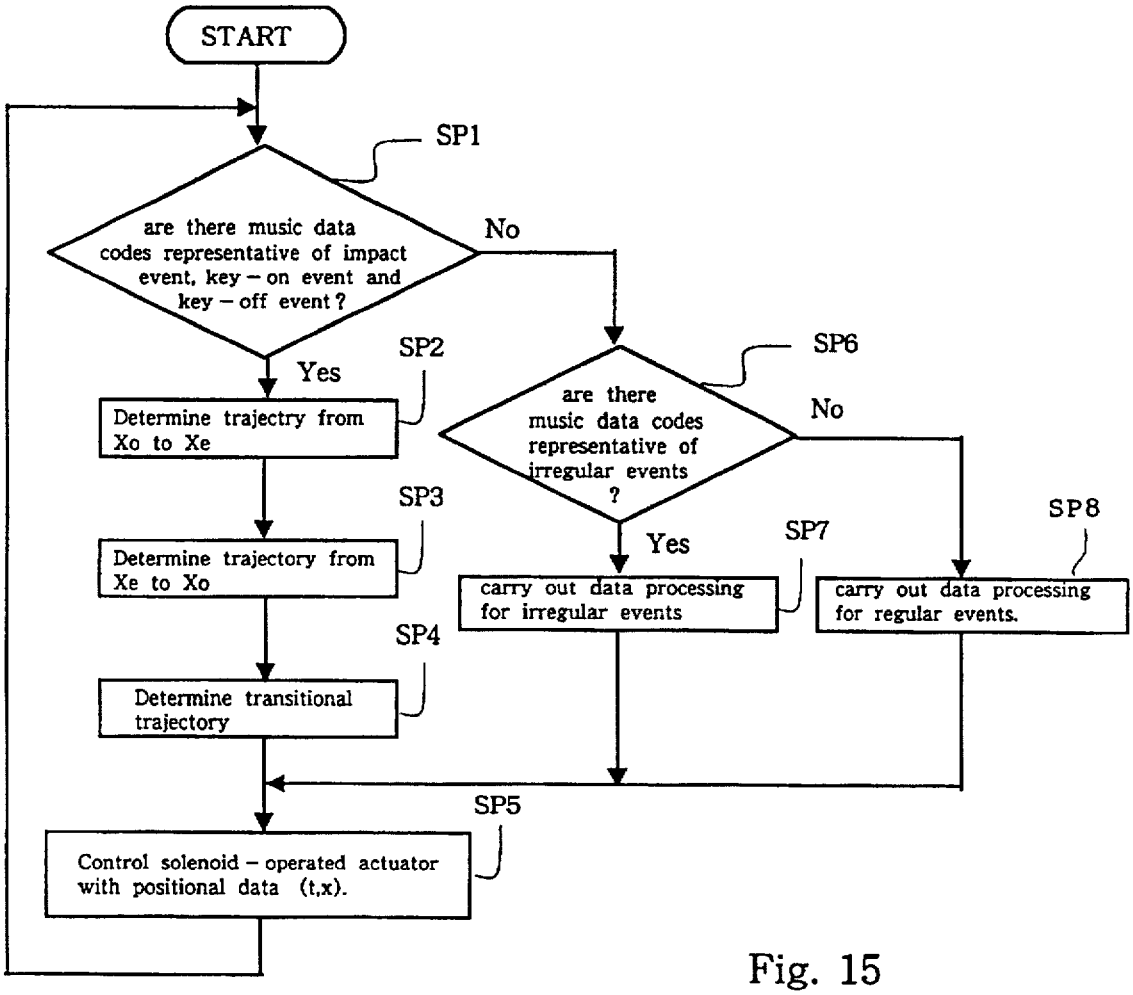
FIG. 15 is a flow chart showing a program sequence executed by a playback sub-system incorporated in the automatic player piano in a playback mode.

On the other hand, when the automatic player piano is requested to reproduce an original performance, a series of music data codes/interval data codes is supplied from the memory sub-system 20*m* or the data port 20*n* to the playback sub-system 20*o*. The playback sub-system 20*o* processes the music data codes/interval data codes as shown in FIG. 15. When a group of music data code(s)/interval data code(s) representative of a set of key motions is supplied to the pretreatment unit 20*r*, the pretreatment unit 20*r* checks the group of music data code(s)/interval data code(s) to see whether or not there are the music data code representative of the impact event, the key-on event and the key-off event as by step SP1.

If the answer at step SP1 is given affirmative, the pianist manipulated the key 10*b* in the standard key touch, and the pretreatment unit 20*r* determines a linear trajectory from the rest position Xo to the end position Xe expressed by equation 5 as by step SP2. The data processing for the linear trajectory has been already detailed hereinbefore.

Thereafter, the pretreatment unit 20*r* proceeds to step SP3, and determines a linear trajectory from the end position Xe to the rest position Xo expressed by equation 8. the data processing for the trajectory has been already detailed hereinbefore.

The pretreatment unit 20*r* determines a transitional trajectory for the linear trajectories already obtained through steps 2 and 3. The pretreatment unit 20*r* firstly calculates the transit point tc by using equation 14 and the accelerations aP and aN by using equations 16 and 20. Subsequently, equations 17 and 21 determine a decelerating trajectory and an accelerating trajectory on the basis of the accelerations aP and aN. The decelerating trajectory and the accelerating trajectory link the linear trajectories with each other, and the pretreatment unit 20r obtains a composite trajectory which consists of a part of the linear trajectory from the rest position Xo, the transitional trajectory, i.e., the decelerating/accelerating trajectories to and from the transit point tc and the linear trajectory to the rest position Xo. However, if the linear trajectory expressed by equation 5 does not cross the linear trajectory expressed by equation 8, the pretreatment unit 20r does not carry out the data processing at step SP4.

When the pretreatment unit 20r obtains the pair of linear trajectory or the composite trajectory, the pretreatment unit 20r produces a series of positional data (t, X) on the trajectory. Time t may be incremented from time t0 to time t4 at constant intervals, or incremented at short intervals on the decelerating/accelerating trajectories rather than the linear trajectories. If the intervals on the decelerating/accelerating trajectories are shorter than those on the linear trajectories, the solenoid-operated actuator can precisely smoothly control the key 10b to be moved without drastic increase of the position data (t, X).

The pretreatment unit 20r determines the target key position X on the composite trajectory changed with time. The target position X is changed from time t0 to time tPT on the linear trajectory expressed by equation 5, from time tPT to time tc along the decelerating trajectory expressed by equation 19, from time tc to time tNT along the accelerating trajectory expressed by equation 23 and the linear trajectory from time tNT to time t4 along the linear trajectory expressed by equation 8. The pretreatment unit 20r determines the series of positional data (t, X) in this way, and stores it in a memory incorporated therein. The target positions X are sequentially stored from a certain address, and the address is incremented with time t.

The motion controller 20s periodically fetches the target position X, and instructs the servo-controller 20t to control the current key position as by step SP5. The servo-controller 20t regulates the driving current signal DR so as to match the current key position with the target key position X. The solenoid-operated actuator 20a associated with the key 10b to be moved projects the plunger 20e, and the plunger 20e moves the key 10b to the target position X. The key 10b causes the key action mechanism 10e to rotate the hammer assembly 10f toward the set of strings 10g. The hammer head 10fb strikes the strings 10g at the impact time ti at the intensity equal to that of the original performance, and the strings 10g vibrate to generate the acoustic sound. The key 10b is released after the escape of the hammer assembly 10f, and the solenoid-operated actuator 20a causes the key 10b to return to the rest position Xo along the composite trajectory. Upon completion of step SP5, the playback sub-system 20o returns to step SP1, and repeats step SP1 for another group of music data codes/interval data codes.

If a group of music data codes/interval data codes does not contain a pair of key-on event and key-off event, the answer at step Sp1 is given negative, and the pretreatment unit 20r proceeds to step SP6. The pretreatment unit 20r checks the music data codes to see whether or not there are the music data codes representative of irregular events.

If the answer at step SP6 is given affirmative, the pretreatment unit 20r proceeds to step SP7, and carries out a data processing for the irregular events. For example, the group of music data codes/interval data codes is assumed to contain the music data codes described in connection with FIG. 12, i.e., the missing key-off event/missing keyoff-to-keyon event/time interval/impact event. The pretreatment unit 20r calculates a linear trajectory by using equation 24, a linear trajectory by using equation 28, a decelerating trajectory by using equation 28 and an accelerating trajectory by using equation 34. On the other hand, if the group contains the music data codes described in connection with FIG. 13, i.e., time interval/missing keyon event/missing keyoff-to-keyon event, the pretreatment unit 20r calculates a linear trajectory by using equation 35, a linear trajectory by using equation 36, a decelerating trajectory by using equation 31 and an accelerating trajectory by using equation 32.

When the pretreatment unit 20r determines a series of positional data (t, X) representative of the composite trajectory, the playback sub-system 20o proceeds to step SP5 for controlling the solenoid-operated actuator associated with the key 10b to be moved.

On the other hand, if the group cones not contain the music data codes representative of irregular events, the answer at step SP6 is given negative, and the pretreatment unit 20r proceeds to step SP8 so as to carry out the data processing as follows.

(i) If the group contains the key-on event and the key-off event but does not contain an impact event, the pretreatment unit 20r interprets that the pianist terminated the performance before a strike at the strings, and calculates a trajectory for the depressed key on the basis of the key velocity and the key depressing time.

(ii) If the group contains the impact event but does not contain a key-on event and a key-off event, the pretreatment unit 20r interprets that the group represents a kind of half stroke. In case where the previous key position is closer to the rest position Xo than the end position Xe, the key 10b was not depressed to the key position K2. On the other hand, if the previous key position is closer to the end position Xe, the key did not return to the key position K3. In this situation, the pretreatment unit 20r calculates a trajectory for the depressed key 10b on the basis of the hammer velocity vH and the impact time ti, and, thereafter, determines a trajectory for the released key.

(iii) If the group contains the keyon event and the key-off event but does not contain an impact event, the pretreatment unit 20r interprets the group to represent a silent note as shown in FIG. 14. The pretreatment unit 20r determines a trajectory for the depressed key on the basis of the key velocity Vk and the key depressing time tK and a trajectory for the released key on the basis of the released key velocity VkN and the extinct time tkN.

As will be appreciated from the foregoing description, the automatic playing system according to the present invention forms the irregular events into the music data codes, and reproduces the non-standard key touches in the playback. For example, when a key 10b was moved along the composite trajectory TR7 shown in FIG. 12, the prior art automatic playing system does not generate a key-off event and a key-on event, and the linear trajectory between time t0 and time t1 is never reproduced. However, the automatic playing system according to the present invention can reproduce the trajectory between time t0 and time t1 on the basis of the approximate released key velocity stored in the music data code representative of the missing keyoff-to-keyon event.

Moreover, the automatic playing system according to the present invention divides the space between the end position Xe to the rest position Xo into three sections, and describes the key motion in each of the three sections. As a result, the playback sub-system 20o exactly reproduces the key motion in the playback mode. Even if the key is maintained at a certain position, the automatic playing system can describe the key status.

The irregular events are formed into the same format as the regular events. The irregular events are analogous to the regular events, and the format allows the automatic playing system to consistently process the music data codes. The music data code representative of the irregular event allows the playback sub-system 20*o* to specify the section where the key 10*b* is, and the playback sub-system 20*o* easily continues the data processing in the playback mode in spite of a missing event.

Although a particular embodiment of the present invention has been shown and described, it will be obvious to those skilled in the art that various changes and modifications may be made without departing from the spirit and scope of the present invention.

(i) A keyboard musical instrument may not have one of the recording sub-system and the playback sub-system.

(ii) In the above described embodiment, a key motion is represented by the key-on event, the impact event and the key-off event. The key-on event may be omissible, because the reference velocity Vr is calculated from the hammer velocity vH by using equation 3. The impact event may be generated by monitoring the strings. The key-off event may be generated at an arrival at the rest position. When the damper head 10*i* is brought into contact with the strings again, the key-off event may be generated. Thus, the generation of event is not limited to those of the embodiment.

(iii) In the embodiment, the irregular event and the regular event are represented by "8" and "0", respectively. Only the irregular event may be specified by a certain code.

(iv) In the embodiment, the first byte and the lower 4 bits of the third byte represent a missing key event. A missing key event may be represented by a certain code.

(v) A missing impact event may be represented by a music data code such as [(9 0) (0 0) (0 8)].

(vi) In the above embodiment, when the recording sub-system 20*k* generates the missing keyoff-to-keyon event, the missing key-on event is concurrently generated. However, the missing key-on event is generated after the missing keyoff-to-keyon event at all times. The missing key-on event is omissible. Similarly, the missing key-off event is omissible after the missing keyon-to-keyoff event.

(vii) When a group of music data codes/interval data code(s) contains the key-on event but does not contain the impact event, the playback sub-system may fix the key velocity to a predetermined constant value which does not result in a strike at the strings.

What is claimed is:

1. An automatic player piano comprising:

an acoustic piano including a plurality of vibrating means for generating acoustic sounds through vibrations thereof, and a plurality of striking mechanisms respectively associated with said plurality of vibrating means and selectively actuated from a first position toward a second position so as to make vibrating means associated with actuated striking mechanisms vibrate; and an automatic playing system including a plurality of actuators respectively associated with said plurality of striking mechanisms for selectively actuating said plurality of striking mechanisms, a plurality of monitoring means respectively associated with said plurality of striking mechanisms for generating a plurality of pieces of status data information respectively representative of motions of said plurality of striking mechanisms, and a recording sub-system connected to said plurality of monitoring means for obtaining said plurality of pieces of status data information, and generating at least a first piece of music data information representative of a regular key-on event for one of said plurality of striking mechanisms actuated from said first position to said second position, a second piece of music data information representative of an impact event for one of said plurality of striking mechanisms which makes associated one of said plurality of vibrating means generate the acoustic sound, a third piece of music data information representative of a regular key-off event for one of said plurality of striking mechanisms moved from said second position to said first position, a fourth piece of music data information representative of an irregular key-on event for one of said plurality of striking mechanisms actuated at a first intermediated point between said first position and said second position toward said second position and a fifth piece of music data information representative of an irregular key-off event for one of said plurality of striking mechanism moved from a second intermediate point between said first position and said second position toward said first position, said first, second and third pieces of music data information being used for reproducing a key motion analogous to an original key motion having said regular key-on event and said regular key-off event, at least one of said fourth piece of music data information and said fifth piece of music data information being used for producing another key motion having at least one of said irregular key-on event and said irregular key-off event together with at least one of said first, second and third pieces of music data information.

2. The automatic player piano as set forth in claim 1, in which each of said plurality of striking mechanisms includes a key turnable between a rest position and an end position, a hammer driven for rotation so as to strike associated one of said plurality of vibrating means, and a key action mechanism connected to said key and causing said associated one of said plurality of vibrating means to escape therefrom on the way from said rest position toward said end position so that said hammer starts a free rotation toward said associated one of said plurality of vibrating means, one of said plurality of monitoring means associated with said each of said plurality of striking mechanisms includes a key sensor monitoring said key for generating a key position signal changing the value thereof at at least two key positions between said rest position and said end position, and a hammer sensor monitoring said hammer for generating a hammer position signal, said recording sub-system determining an impact timing for striking said associated one of said plurality of vibrating means with said hammer and a hammer velocity in the vicinity of said impact timing on the basis of said hammer position signal.

3. The automatic player piano as set forth in claim 2, in which said each of said plurality of striking mechanisms further includes a damper mechanism spaced from said one of said plurality of vibrating means on the way from said rest position toward said end position and brought into contact with said one of said plurality of vibrating means on the way from said end position toward said rest position, and said regular key-off event takes place substantially concurrent with a timing when said damper mechanism is brought into contact with said one of said plurality of vibrating means.

4. The automatic player piano as set forth in claim 1, in which said recording sub-system further generates pieces of time data information each representative of a timing when one of said first to fifth pieces of music data information takes place.

5. The automatic player piano as set forth in claim 4, further comprising a memory sub-system connected to said recording sub-system for storing said first to fifth pieces of music data information and said pieces of time data information.

6. The automatic player piano as set forth in claim 4, in which said fourth piece of music data information contains a first sub-piece of music data information representative of said irregular key-on event and a second sub-piece of music data information representative of a continuous irregular key-off event which takes place after said irregular key-on event, and said fifth piece of music data information contains a third sub-piece of music data information representative of said irregular key-off event and a fourth sub-piece of music data information representative of a continuous key-on event which takes place after said irregular key-off event, one of said pieces of time data information and another of said pieces of time data information being associated with a first combination of said irregular key-on event and said continuous irregular key-off event and a second combination of said irregular key-off event and said continuous irregular key-on event.

7. An automatic player piano comprising:

an acoustic piano including a plurality of vibrating means for generating acoustic sounds through vibrations thereof, and a plurality of striking mechanisms respectively associated with said plurality of vibrating means and selectively actuated from a first position toward a second position so as to make vibrating means associated with actuated striking mechanisms vibrate; and an automatic playing system including a plurality of actuators respectively associated with said plurality of striking mechanisms for selectively actuating said plurality of striking mechanisms, and a playback sub-system connected to said plurality of actuators for reproducing a regular key motion on the basis of a first piece of music data information representative of a regular key-on event for one of said plurality of striking mechanisms actuated from said first position to said second position, a second piece of music data information representative of an impact event for said one of said plurality of striking mechanisms which makes associated one of said plurality of vibrating means generate the acoustic sound, and a third piece of music data information representative of a regular key-off event for one of said plurality of striking mechanisms moved from said second position to said first position and an irregular key motion on the basis of at least one of a fourth piece of music data information representative of an irregular key-on event for another of said plurality of striking mechanisms actuated at a first intermediated point between said first position and said second position toward said second position, and a fifth piece of music data information representative of an irregular key-off event for yet another of said plurality of striking mechanism moved from a second intermediate point between said first position and said second position toward said first position together with at least one of said first, second and third pieces of music data information.

8. The automatic player piano as set forth in claim 7, in which pieces of time data information are further supplied to said playback sub-system, and each of said pieces of time data information represents a timing when one of said first to fifth pieces of music data information takes place so that said playback sub-system reproduces said regular key motion and said irregular key motion at the same timings in a playback as those in an original performance.

9. The automatic player piano as set forth in claim 8, in which said first piece of music data information, said second piece of music data information, said third piece of music data information, said fourth piece of music data information and said fifth piece of music data information contain a first calculated key velocity, a calculated hammer velocity, a second calculated key velocity, a first estimated key velocity and a second estimated key velocity, respectively, and said playback sub-system determines a trajectory for said regular key motion on the basis of said first to third pieces of music data information and a trajectory for said irregular key motion on the basis of a first combination of selected ones of said pieces of time data information, said calculated hammer velocity and one of said first and second estimated key velocities, a second combination of selected ones of said pieces of time data information and one of said first and second estimated key velocities or a third combination of selected one of said pieces of time data information and said first and second calculated key velocities.

10. The automatic player piano as set forth in claim 7, in which said automatic playing system further includes a plurality of monitoring means respectively associated with said plurality of striking mechanisms for generating a plurality of pieces of status data information respectively representative of motions of said plurality of striking mechanisms, and a recording sub-system connected to said plurality of monitoring means for obtaining said plurality of pieces of status data information, and generating at least said first to fifth pieces of music data information.

* * * * *